US009031200B2

(12) United States Patent
Ho et al.

(10) Patent No.: US 9,031,200 B2
(45) Date of Patent: May 12, 2015

(54) INTERLEAVING MULTI-ENERGY X-RAY ENERGY OPERATION OF A STANDING WAVE LINEAR ACCELERATOR

(75) Inventors: Ching-Hung Ho, Antioch, CA (US); Stephen Wah-Kwan Cheung, Mountain View, CA (US); Roger Heering Miller, Mountain View, CA (US); Juwen Wang, Sunnyvale, CA (US)

(73) Assignee: Accuray Incorporated, Sunnyvale, CA (US)

( * ) Notice: Subject to any disclaimer, the term of this patent is extended or adjusted under 35 U.S.C. 154(b) by 0 days.

(21) Appl. No.: 13/610,594

(22) Filed: Sep. 11, 2012

(65) Prior Publication Data

US 2013/0063052 A1 Mar. 14, 2013

Related U.S. Application Data

(63) Continuation-in-part of application No. 12/718,901, filed on Mar. 5, 2010, now Pat. No. 8,284,898.

(51) Int. Cl.

| | |
|---|---|
| ***H05G 2/00*** | (2006.01) |
| ***H05H 9/04*** | (2006.01) |
| ***H05H 7/12*** | (2006.01) |
| ***H05H 9/02*** | (2006.01) |

(52) U.S. Cl.
CPC . *H05H 9/04* (2013.01); *H05H 7/12* (2013.01); *H05H 9/02* (2013.01)

(58) Field of Classification Search
CPC ..... H05H 7/00; H05H 7/12; H05H 7/18; H05H 9/00; H05H 9/04; H05H 9/041; H05H 9/044; G21K 5/04; H05G 2/00
USPC ..... 378/64, 65, 68, 119; 315/5.41, 505
See application file for complete search history.

(56) References Cited

U.S. PATENT DOCUMENTS

| | | | | |
|---|---|---|---|---|
| 2,920,228 | A | 1/1960 | Gizton | |
| 2,993,141 | A | 7/1961 | Post | |
| 3,820,035 | A | 6/1974 | Meddaugh | |
| 4,024,426 | A | 5/1977 | Vaguine | |
| 4,122,373 | A * | 10/1978 | Vaguine | 315/5.41 |

(Continued)

FOREIGN PATENT DOCUMENTS

| | | |
|---|---|---|
| JP | 2008198522 A | 8/2008 |
| JP | 2008218053 A | 9/2008 |

(Continued)

OTHER PUBLICATIONS

Jiquan Guo and Sami Tantawi, "Active RF pulse compression using an electrically controlled semiconductor switch," New Journal of Physics 8 (2006), 293.*

(Continued)

*Primary Examiner* — Allen C. Ho
(74) *Attorney, Agent, or Firm* — Lowenstein Sandler LLP

(57) ABSTRACT

The disclosure relates to systems and methods for interleaving operation of a standing wave linear accelerator (LINAC) for use in providing electrons of at least two different energy ranges, which can be contacted with x-ray targets to generate x-rays of at least two different energy ranges. The LINAC can be operated to output electrons at different energies by varying the power of the electromagnetic wave input to the LINAC, or by using a detunable side cavity which includes an activatable window.

19 Claims, 19 Drawing Sheets

(56) References Cited

U.S. PATENT DOCUMENTS

| | | | | |
|---|---|---|---|---|
| 4,286,192 | A * | 8/1981 | Tanabe et al. | 315/5.41 |
| 4,382,208 | A * | 5/1983 | Meddaugh et al. | 315/5.41 |
| 4,629,938 | A * | 12/1986 | Whitham | 315/5.41 |
| 4,713,581 | A | 12/1987 | Haimson | |
| 5,381,072 | A | 1/1995 | Tanabe | |
| 5,744,919 | A * | 4/1998 | Mishin et al. | 315/505 |
| 5,796,314 | A | 8/1998 | Tantawi et al. | |
| 5,801,598 | A | 9/1998 | Tantawi et al. | |
| 5,821,705 | A * | 10/1998 | Caporaso et al. | 315/507 |
| 5,949,811 | A | 9/1999 | Baba et al. | |
| 6,366,021 | B1 * | 4/2002 | Meddaugh et al. | 315/5.41 |
| 6,366,641 | B1 | 4/2002 | Whitham | |
| 6,369,585 | B2 * | 4/2002 | Yao | 324/636 |
| 6,376,990 | B1 * | 4/2002 | Allen et al. | 315/5.41 |
| 6,407,505 | B1 * | 6/2002 | Bertsche | 315/5.41 |
| 6,459,761 | B1 | 10/2002 | Grodzins et al. | |
| 6,459,762 | B1 | 10/2002 | Wong et al. | |
| 6,465,957 | B1 | 10/2002 | Whitham et al. | |
| 6,493,424 | B2 | 12/2002 | Whitham | |
| 6,674,254 | B2 | 1/2004 | Hanna et al. | |
| 6,864,633 | B2 | 3/2005 | Trail et al. | |
| 6,954,515 | B2 * | 10/2005 | Bjorkholm et al. | 378/137 |
| 6,977,987 | B2 | 12/2005 | Yamashita et al. | |
| 7,005,809 | B2 | 2/2006 | Whitham et al. | |
| 7,112,924 | B2 * | 9/2006 | Hanna | 315/5.41 |
| 7,130,371 | B2 | 10/2006 | Elyan et al. | |
| 7,202,486 | B2 | 4/2007 | Gentry et al. | |
| 7,239,095 | B2 * | 7/2007 | Ho et al. | 315/505 |
| 7,339,320 | B1 * | 3/2008 | Meddaugh et al. | 315/5.41 |
| 7,400,093 | B2 | 7/2008 | Salop et al. | |
| 7,580,505 | B2 | 8/2009 | Kang et al. | |
| 7,645,994 | B2 | 1/2010 | Tang et al. | |
| 7,646,851 | B2 | 1/2010 | Liu et al. | |
| 7,881,424 | B2 | 2/2011 | Zhang et al. | |
| 8,203,289 | B2 * | 6/2012 | Ho et al. | 315/505 |
| 8,232,747 | B2 * | 7/2012 | Crewson et al. | 315/505 |
| 8,284,898 | B2 * | 10/2012 | Ho et al. | 378/119 |
| 8,311,187 | B2 | 11/2012 | Treas et al. | |
| 2005/0057198 | A1 | 3/2005 | Hanna | |
| 2007/0035260 | A1 | 2/2007 | Ho et al. | |
| 2007/0215813 | A1 | 9/2007 | Whitman et al. | |
| 2007/0248214 | A1 | 10/2007 | Smith | |
| 2008/0037843 | A1 | 2/2008 | Fu et al. | |
| 2008/0211431 | A1 * | 9/2008 | Mishin et al. | 315/505 |
| 2010/0034355 | A1 | 2/2010 | Langeveld et al. | |
| 2010/0038563 | A1 | 2/2010 | Chen et al. | |
| 2010/0111388 | A1 | 5/2010 | Seppi et al. | |
| 2010/0188027 | A1 | 7/2010 | Treas et al. | |
| 2010/0310045 | A1 | 12/2010 | Brown et al. | |
| 2011/0006708 | A1 | 1/2011 | Ho et al. | |
| 2012/0081041 | A1 | 4/2012 | Cheung et al. | |
| 2012/0081042 | A1 | 4/2012 | Cheung et al. | |

FOREIGN PATENT DOCUMENTS

| | | | |
|---|---|---|---|
| WO | 2007134514 | A1 | 11/2007 |
| WO | 2009080080 | A1 | 7/2009 |
| WO | 2010019228 | A1 | 2/2010 |

OTHER PUBLICATIONS

Fumihiko Tamura and Sami G. Tantawi, "Development of high power X-band semiconductor microwave switch for pulse compression systems of future linear colliders," Physical Review Special Topics—Accelerators and Beams, vol. 5, 062001 (2002).*

A01 et al., "SU-FF-T-155: Development of an ultra-small C-band linear accelerator guide and automatic frequency controller," Med. Phys., vol. 34, issue 6, Jun. 2007, pp. 2436-2437.

International Search Report for PCT/US2010/021919, 3 pages, mailed Jun. 30, 2010.

Written Opinion of the International Searching Authority for PCT/US2010/021919, 8 pages, mailed Jun. 30, 2010.

Hanna, "Review of Energy Variation Approaches in Medical Accelerators," Proceedings of EPAC08 Genoa, Italy, pp. 1797-1799 (Jul. 2008).

International Search Report for PCT/US2010/040864, 4 pages, mailed Nov. 11, 2010.

Written Opinion of the International Searching Authority for PCT/US2010/040864, 9 pages, mailed Nov. 11, 2010.

Karzmark et al., "Medical Electron Accelerators," McGraw-Hill, Inc., 1993, pp. 82-87.

Maciszewski et al., -Application of 'Electronica 10-10' Electron Linac for Food Processing, 4th European Particle Accelerator Conference, Jun. 27-Jul. 1, 1994, London, England, pp. 2644-2646.

Pirozfienko, "Efficient Traveling-Wave Accelerating Structure for Linear Accelerators," Proceedings of EPAC08, Jun. 23-27, 2008, Genoa, Italy, pp. 2746-2748.

International Search Report for PCT/US2011/022834, mailed May 24, 2011, 4 pages.

Written Opinion of the International Searching Authority for PCT/US2011/022834, mailed May 24, 2011, 7 pages.

D'Auria et al "A New Electron Gun Modulator for the LINAC," Proceedings of LINAC96, Aug. 1996, pp. 854-856.

Hernandez et al., "A 7MeV S-Band 2998MHz Variable Pulse Length Linear Accelerator System," Proceedings of 2005 Particle Accelerometer Conference, Knoxville, Tennessee, pp. 1895-1897.

Pont et al. "Status of the 100 MeV Preinjector for the ALBA Synchrotron," Proceedings of EPAC08, Jul. 2008, Genoa, Italy, pp. 811-813.

Purdy et al., -Dual energy x-ray beam accelerators in radiation therapy: an overview, Nuclear Instruments and Methods in Physics Research BIO/B11, 1985, pp. 1090-1095.

Toma et al. "Aspects of the Control System for the Electron Linear Accelerators Built in Romania," International Conference on Accelerator and Large Experimental Physics Control Systems, 1999, Trieste, Italy, pp. 654-656.

USPTO Non-Final Office Action for U.S. Appl. No. 12/499,644, mailed Nov. 15, 2011, 11 pages.

USPTO Non-Final Office Action for U.S. Appl. No. 12/581,086, mailed Nov. 8, 2011, 6 pages.

USPTO Non-Final Office Action for U.S. Appl. No. 12/697,0 1, mailed Dec. 22, 2011, 18 pages.

Birdsey et al., "Pierce geometry electron guns as off-the-shelf nanosecond pulsed electron sources," Australian Institute of Physics 17th National Congress, Brisbane, Dec. 3-8, 2006, 4 pages.

Chetverikov et al., "The tuning method of the biperiodic accelerating structure of electron linear accelerator." Problems of Atomic Science and Technology (PAST), Ukraine, 2001, No. 3, pp. 99-100.

Dovbnya et al, "Two-frequency klystron amplifier," XVIII International Linac Conference, Geneva, Switzerland, Aug. 26-30, 2006, 3 pages.

Green, "Linear accelerators for radiation therapy, second edition" Taylor & Francis Group, New York, NY, pp. 27-47 (1997).

Guo et al., "Active RI; pulse compression using an electrically controlled semiconductor switch," New Journal of Physics 8 (2006) 293, 17 pages.

Guo et al., -Active RF pulse compression using electrically controlled semiconductor switches, Contributed to 12th Advanced Accelerator Concepts Workshop (AAC 2006), Jul. 10, 2006 to Jul. 15, 2006, Lake Geneva, Wisconsin, 7 pages.

Guo et al., "Active RF pulse compression using electrically controlled semiconductor switches," Proceedings of EPAC 2006, Edinburgh, Scotland, pp. 3140-3142.

Huang et al, "Electron gun used in the accelerator for customs inspection systems," Proceedings of the Second Asian Particle Accelerator Conference, Beijing, China, 2001, 3 pages.

Iwashita, "Disk-and-washer LINAC structure with biperiodic T supports," IEEE Transactions on Nuclear Science, vol. NS-30, No. 4, Aug. 1983, pp. 3542-3544.

Jang et al., "Perveance monitor for measuring an 80-MW klystron characteristics," Proceedings of APAC 2004, Gyeongju, Korea, pp. 610-612.

Kamino et al., "Development of a new concept automatic frequency controller for an ultrasmall C-band linear accelerator guide," Med. Phys., vol. 34, issue 8, Aug. 2007, pp. 3243-3248.

Kiiodak et al., "Electron gun for technological linear accelerator," Problems of Atomic Science and Technology (PAST), Ukraine, 2000, No. 2, pp. 86-88.

(56) References Cited

OTHER PUBLICATIONS

Miller et al., "Comparison of standing-wave and traveling-wave structures," Invited paper presented at the Stanford Linear Accelerator Conference, Stanford, California, Jun. 2-6, 1986, 6 pages.
Nantista et al.. "Calculating RF profiles for beam loading compensation of arbitrary current profiles," Next Linear Collider (NLC) Note #25, Aug. 1997, 11 pages.
Ogorodnikov et al., "Processing of interlaced images in 4-10 MeV dual energy customs system for material recognition," Physical Review Special Topics—Accelerators and Beams, vol. 5, 104701 (2002), 11 pages.
Oki et al., "Low output-impedance RF system for beam loading compensation," Research Center for Nuclear Physics (RCNP) Annual Report 2001, Osaka University, Japan, 2 pages.
Tamura et al. "Development of high-power X-band semiconductor microwave switch for pulse compression systems of future linear colliders," Physical Review Special Topics—Accelerators and Beams, vol. 5, 062001 (2002), 16 pages.
U.S. Appl. No. 12/697,031, filed Jan. 29, 2010, Treas et al.

* cited by examiner

INTERLEAVING MULTI-ENERGY X-RAY ENERGY OPERATION OF A STANDING WAVE LINEAR ACCELERATOR

CROSS-REFERENCE TO RELATED APPLICATIONS

This application is a divisional under 35 U.S.C. §121 of U.S. patent application Ser. No. 12/718,901, filed Mar. 5, 2010, now U.S. Pat. No. 8,284,898, issued on Oct. 9, 2012 and entitled "Interleaving Multi-Energy X-Ray Energy Operation of a Standing Wave Linear Accelerator," the entire contents of which are incorporated by reference herein.

1. FIELD OF THE INVENTION

The invention relates to systems and methods for interleaving operation of a standing wave linear accelerator for use in generating x-rays of at least two different energy ranges.

2. BACKGROUND OF THE INVENTION

Linear accelerators (LINACs) are useful tools for medical applications, such as radiation therapy and imaging, and industrial applications, such as radiography, cargo inspection and food sterilization. In some of these applications, beams of electrons accelerated by the LINAC are directed at the sample or object of interest for performing a procedure or for analysis. However, in many of these applications, it can be preferable to use x-rays to perform the procedure or analysis. These x-rays are generated by directing the electron beams from the LINAC at an x-ray emitting target.

Since a standing wave LINAC can be made smaller than a traveling wave LINAC, a standing wave LINAC can be preferable for medical applications due to space available for medical instruments and some mobile industrial applications. In some medical applications, x-rays of more than one energy band may be desirable for analysis or to perform a procedure, such as radiation therapy in which the ionizing x-ray radiation is used to control malignant cells as part of cancer treatment. A LINAC can be operated to generate alternating outputs of electrons of different energy ranges, which can be used to generate x-rays of different energy bands. However, the accelerating structure of a standing wave LINAC is generally configured to support only a limited number of allowed modes when the accelerator is operating efficiently, only one of which can accelerate a beam efficiently. It has been difficult to develop an instrument that can operate stably to output electrons at different energies at a sufficiently high dose rate of electrons for the desired applications.

Systems and methods are disclosed herein for a multi-energy operation of a standing wave LINAC.

3. SUMMARY

Provided herein are methods and standing wave linear accelerators capable of interleaving multi-energy x-ray operation.

Under one aspect, a method for generating a high dose rate of electrons of different energies using a standing wave linear accelerator includes: (a) coupling a first electromagnetic wave into said accelerator; (b) applying a first electron beam current and a first voltage to an electron gun to eject a first set of electrons from said electron gun into a longitudinal passageway of said accelerator, wherein said first set of electrons is emitted at a first energy; and (c) applying a second electron beam current and a second voltage to said electron gun to eject a second set of electrons from said electron gun into said longitudinal passageway, wherein said second set of electrons is emitted at a second energy. Said second energy is different from said first energy. For example, the second energy can be higher than the first energy, or can be lower than the first energy.

In some embodiments, the method further includes, after step (b) and prior to step (c), coupling a second electromagnetic wave into said accelerator, wherein a power of said second electromagnetic wave is different than a power of said first electromagnetic wave. For example, the power of the second electromagnetic wave can be higher than that of the first electromagnetic wave, or can be lower than that of the first electromagnetic wave.

In some embodiments, a magnitude of said second electron beam current is different than a magnitude of the first electron beam current. For example, the magnitude of the second electron beam current can be higher than that of the first electron beam current, or can be lower than that of the first electron beam current.

In some embodiments, a magnitude of said second voltage is different than a magnitude of said first voltage. For example, the second voltage can be higher than the first voltage, or lower than the first voltage. In some embodiments, the accelerator includes one or more main cavities positioned along a longitudinal axis of said accelerator, and said electromagnetic wave includes a plurality of crests.

In some embodiments, one of said first energy and said second energy is approximately equal to a maximum attainable energy of said accelerator. In some embodiments, at least one of said first energy and said second energy is below a maximum attainable energy of said accelerator.

Some embodiments further include at least one of tuning the first voltage such that said first set of electrons is accelerated at or near multiple crests of said plurality of crests, and tuning the second voltage such that said second set of electrons is accelerated at or near multiple crests of said plurality of crests.

Under another aspect, a method is provided for generating a beam of x-rays at a two different ranges of x-ray energies from a target positioned near a first end of a standing wave linear accelerator, wherein said accelerator includes an electron gun positioned at a second end of said accelerator opposite to said first end. The method includes: coupling an electromagnetic wave into said accelerator; applying a first electron beam current and a first voltage to an electron gun to eject a first set of electrons from said electron gun into a longitudinal passageway of said accelerator, wherein said first set of electrons is emitted at a first energy; contacting said target with said first set of electrons, thereby generating a first beam of x-rays having energies in a first range of x-ray energies from said target; applying a second electron beam current and a second voltage to said electron gun to eject a second set of electrons from said electron gun into said longitudinal passageway, wherein said second set of electrons is emitted at a second energy, wherein said second energy is greater than said first energy; and contacting said target with said second set of electrons, thereby generating a second beam of x-rays having energies in a second range of x-ray energies from said target.

Under another aspect, a method for generating electrons at multiple energies using a standing wave linear accelerator includes: coupling an electromagnetic wave into an accelerator, wherein said accelerator includes a plurality of main cavities and a plurality of side cavities, wherein each said side cavity communicates with two neighboring main cavities of said plurality of main cavities, and wherein at least one side cavity of said plurality of side cavities includes an activatable window positioned in said at least one side cavity; and injecting a first set of electrons into a longitudinal passageway positioned along a longitudinal axis of said accelerator, wherein said longitudinal passageway communicates with said plurality of main cavities, wherein said first set of electrons is accelerated by said electromagnetic wave in a region of said longitudinal passageway in communication with at least one of said main cavities, and wherein said first set of electrons is emitted from said accelerator at a first energy when said activatable window is not activated. The method further includes activating said at least one activatable window; and injecting a second set of electrons into said longitudinal passageway; wherein said second set of electrons is emitted from said accelerator at a second energy when said activatable window is activated.

In some embodiments, said activatable window includes a doped silicon wafer window or a plasma switch. In some embodiments, said activatable window is activated by injecting charge carriers into said activatable window or by applying a current to said activatable window.

In some embodiments, said at least one side cavity includes a longitudinal axis, and wherein said at least one side cavity is positioned such that said longitudinal axis of said least one side cavity is perpendicular to said longitudinal axis of said accelerator. Said at least one side cavity including said activatable window may in some embodiments have a substantially cylindrical cross-section.

In some embodiments, said at least one side cavity including said activatable window includes a resonant TE01 waveguide. Said resonant TE01 waveguide has a length approximately equal to a guided wavelength of the electromagnetic wave. Alternatively, said resonant TE01 waveguide has a length approximately equal to a half of a guided wavelength of the electromagnetic wave. Other lengths are possible.

Said activatable window is, in some embodiments, positioned near an end of said at least one side cavity. A thermal conductor is, in some embodiments, positioned between said activatable window and said end of said one side cavity.

In some embodiments, when said activatable window is not activated, said activatable window transmits more than 50% of a component of said electromagnetic wave which is fed into said at least one side cavity including said activatable window, and wherein said activating said at least one activatable window causes said activatable window to transmit less than 50% of a component of said electromagnetic wave.

Under another aspect, a standing wave linear accelerator includes: a plurality of main cavities and a plurality of side cavities, wherein each said side cavity communicates with two neighboring main cavities of said plurality of main cavities, and wherein at least one side cavity of said plurality of side cavities includes an activatable window positioned in said at least one side cavity, thereby providing at least one detunable side cavity; and wherein said at least one detunable side cavity is configured such that a standing wave is disrupted in main cavities of said plurality of main cavities located downstream of said at least one detunable side cavity when said activatable window is activated.

In some embodiments, said activatable window includes a doped silicon wafer window or a plasma switch. In some embodiments, said activatable window is activated by injecting charge carriers into said activatable window.

In some embodiments, said at least one side cavity including said activatable window has a cylindrical cross-section.

In some embodiments, said at least one side cavity including said activatable window includes a resonant TE01 waveguide. Said resonant TE01 waveguide has a length approximately equal to a guided wavelength of the electromagnetic wave. Alternatively, said resonant TE01 waveguide has a length approximately equal to a half of a guided wavelength of the electromagnetic wave.

In some embodiments, said activatable window is positioned near an end of said at least one side cavity. In some embodiments, a thermal conductor is positioned between said activatable window and said end of said one side cavity.

4. BRIEF DESCRIPTION OF THE DRAWINGS

5. DETAILED DESCRIPTION OF THE INVENTION

The present disclosure relates to systems and methods for multi-energy interleaving operation of a standing wave LINAC.

Standing wave LINACs operate by generating electrons having particular average energies. In operation, electrons that are injected into a standing wave LINAC by an electron gun (described in Section 5.2.1.1), are accelerated and focused along a longitudinal axis of an accelerating structure of the standing wave LINAC using the electric and magnetic field components of an electromagnetic wave that is coupled into the accelerating structure (discussed in Section 5.1 below). The electromagnetic waves are coupled into the accelerating structure from an external source of microwaves, such as a klystron or a magnetron (discussed in Sections 5.1 and 5.4.2). The accelerating structure is configured so that it supports a standing wave mode of the electromagnetic wave. As the electrons traverse the accelerating structure, they are focused and accelerated in a series of main cavities of the accelerating structure of the LINAC by forces exerted on the electrons by the electric and magnetic field components of the electromagnetic wave to produce a high-energy electron beam.

Provided herein are methods and systems for operating a standing wave LINAC to generate electron beams at two or more different energies, i.e., an interleaving operation. As discussed in Section 5.2.1, an interleaving operation of the standing wave LINAC can be accomplished by varying the energy of the electrons that are injected into an accelerating structure of a LINAC, for example, by varying the electron beam current and the voltage applied to an electron gun. As discussed in Section 5.2.2, the interleaving operation can be accomplished by varying the energy of the electron beam output from the standing wave LINAC using a detunable side cavity comprising an activatable window.

5.1 Standing Wave Linear Accelerator

Figure 1:
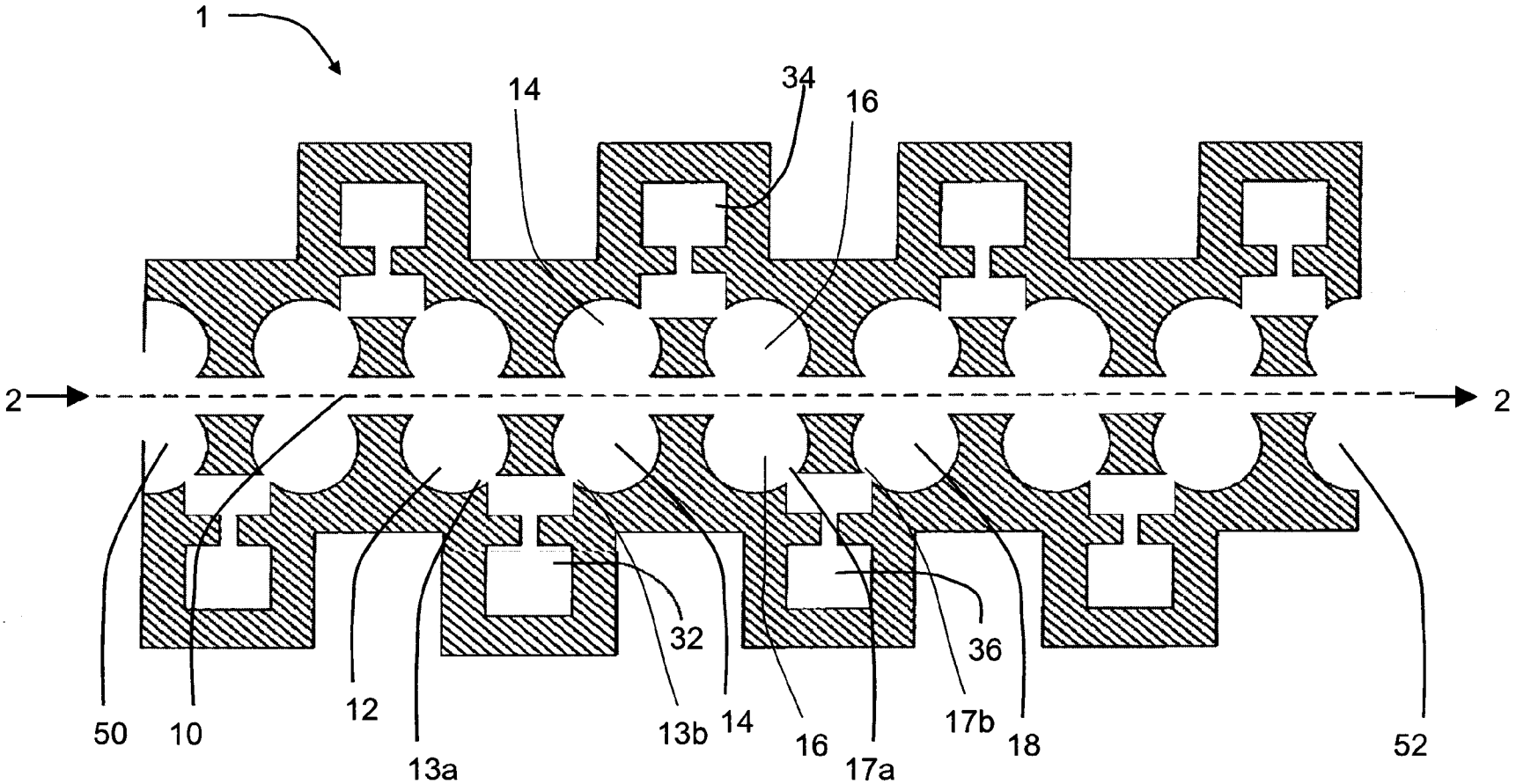
FIG. 1 shows a cross-section of the accelerating structure of a standing wave LINAC structure.

Provided herein are standing wave LINACs and methods of their operation. A cross-section of an exemplary side-coupled standing wave LINAC structure is shown in FIG. 1. The side-coupled standing wave LINAC comprises an accelerating structure 1 that has a longitudinal passageway 10 and a plurality of electromagnetically coupled resonant main cavities 12, 14, 16, 18 positioned along the central bore of the accelerating structure. The longitudinal passageway 10 runs down the center of the accelerating structure. Those of skill in the art will recognize that the standing wave LINACs provided herein can have more or fewer main cavities than shown in the illustration of FIG. 1. For example, a standing wave LINAC can have at least 10, at least 15, at least 20, at least 25, at least 30, at least 35, at least 40, or more main cavities. Main cavities 12, 14, 16, 18 can be shaped like a toroid about the longitudinal passageway 10. A neighboring pair of main cavities is electromagnetically coupled by means of a side cavity through apertures. For example, in FIG. 1, main cavities 12 and 14 are electromagnetically coupled by means of side cavity 32 through apertures 13*a* and 13*b*, while main cavities 16 and 18 are electromagnetically coupled by means of side cavity 36 through apertures 17*a* and 17*b*. Side cavities can be shaped, for example, approximately as a cube, approximately as a cylinder, approximately rectangular, or any other morphology deemed suitable by one of skill. Side cavities can be axisymmetric about a central axis. The standing wave LINAC structure can also comprise an entrance cavity 50 and an exit cavity 52. The entrance cavity 50 and the exit cavity 52 can each be shaped essentially like one half of a main cavity. In certain embodiments, the entrance cavity 50 and the exit cavity 52 can be full cavities, each tuned to a different frequency. Entrance cavity 50 and exit cavity 52 each can have an end wall of finite thickness, with a beam hole similar in size to the longitudinal passageway.

The standing wave LINAC also can comprise an automatic frequency controller (AFC). An AFC can be configured to maintain the tuning of the electromagnetic wave to a desired mode (e.g., a frequency of the electromagnetic wave) during an interleaving operation.

In operation, an electromagnetic wave at around the $\pi/2$ mode resonant frequency of the accelerating structure 1 is coupled into the standing wave LINAC. Generally, the accelerating structure can be resonant at microwave frequencies, typically between 0.3 GHz and 300 GHz. Typically, the microwave can be coupled into one of the main cavities at a point along the longitudinal passageway through an iris or taper junction (not shown) leading from a microwave source. Sources of electromagnetic waves at microwave frequencies, such as a magnetron or a klystron, are discussed in Section 5.4.2. In certain embodiments, the electromagnetic wave can be coupled into one of the main cavities through an opening in the upper or lower portion of the accelerating structure, or into two main cavities through a taper or junction that replaces one of the side cavities. In the latter case, the adjacent main cavities are $\pi$ out of phase so the coupling to the adjacent main cavities can be done with two apertures on opposite sides of the broad wall of a rectangular waveguide where the magnetic field is in opposite directions.

Small LINACs can have a single integral accelerating structure that bunches a pulsed electron beam from an electron gun, accelerates the beam through a tapered phase velocity section, and accelerates the electron beam (i.e., increases the energy of the electrons) through a velocity of light accelerating section. In an example, the electron beam can have no microwave structure when it enters the accelerator. The amplitude and phase velocity of the electromagnetic wave can affect the acceleration of these electrons.

The frequency of the microwave can be such that a standing wave of the input electromagnetic wave is excited in the accelerating structure 1 at an allowed mode of the accelerating structure. The accelerating structure can be configured such that an allowed mode of the accelerating structure is a standing-wave resonance with $\pi/2$ radians phase shift between each side cavity and the adjacent downstream main cavity, or between a main cavity and a downstream side cavity. Thus, in certain embodiments, there can be a shift of $\pi$ radians between adjacent main cavities 12, 14, 16, 18. This standing wave mode can provide the greatest separation of resonant frequency from adjacent modes that might be accidentally excited. That is, the $\pi/2$ mode can provide desirable shunt impedance, wide mode separation, and loose tolerances for phase velocities between about half the velocity of light and the velocity of light, that can be useful for a small LINAC. However, the skilled artisan can appreciate that other phase shifts can be used in accordance with the systems and methods disclosed herein. For example, the systems and methods disclosed herein are also applicable to triperiodic LINAC structures, which comprise three cavities per period, a $2\pi/3$ phase advance per cavity, and a node in every third cavity that are positioned off-axis or are greatly shrunken in length if positioned on-axis. In another example, the systems and methods disclosed herein are also applicable to biperiodic standing wave structures in the π/2 mode that comprise on-axis coupling cavities that perform a function similar to the side cavities discussed herein.

A beam of electrons 2 can be injected by an electron gun (not shown in FIG. 1) into the longitudinal passageway 10 near entrance cavity 50. Electron guns are discussed in Section 5.2.1.1 below. The electron beam 2 can be either continuous or pulsed. In a specific embodiment, the electron beam is pulsed. Accelerating structure 1 can also comprise bunching cavities located between entrance cavity 50 and main cavities 12, 14, 16, 18. The bunching cavities can be configured such that the electric and magnetic field components of the electromagnetic wave in the bunching cavities causes the electron beam to come together to form bunches and to focus and accelerate the electrons. The formation of electron bunches from an initial continuous beam can take place as the electrons traverse the bunching cavities, and the system can be configured so that the bunching is not significantly degraded by the accelerating electric field in the accelerating main cavities. In certain embodiments, the accelerating structure 1 can be configured, and the frequency of the microwave can be selected, such that the spacing between main cavities 12, 14, 16, 18 is about one-half of a free-space wavelength of the microwave (about π radians). In certain embodiments, the injected electron beam 2 (comprising electron bunches) can be accelerated in each of the main cavities towards the exit cavity 52, so that electrons accelerated in one main cavity 12 arrive at the next main cavity 14 at the point in time when the electric field of the microwave in cavity is in a phase that exerts additional forward acceleration on the electron beam 2. The electron beam 2 (comprising electron bunches) is accelerated to nearly the speed of light usually in the first few main cavities. The acceleration exerted by the electric field components of the standing waves in the remaining main cavities further increases the energy of the electrons (i.e., increases their relativistic mass).

After being accelerated, electron beam 2 is emitted from the standing wave LINAC structure from exit cavity 52. In embodiments that use x-ray radiation, the emitted electron beam 2 can be directed at an x-ray target (not shown). The generation of x-rays and examples of targets are discussed in Section 5.3 below. Alternatively, in certain embodiments, a vacuum window comprising a thin metal film can be placed at exit cavity 52 to transmit the electron beam 2 for particle irradiation of a subject. The vacuum window makes it possible to easily move the thin film x-ray target, thus permitting use of either output electrons or x-ray irradiation in a procedure.

In a single section LINAC, if the amplitude of the electromagnetic field is lowered to lower the output energy of the electron beam, the fields decrease by an equal amount in the bunching cavities and accelerating cavities, causing the bunches to fall behind the crest of the electromagnetic wave, which can produce a broad spectrum and poor stability.

For the systems and methods herein, a set of electrons can be accelerated at a crest if it arrives at the center of a cavity (such as a main cavity or a buncher cavity) at a time that the electromagnetic standing wave attains substantially a maximum amplitude at that cavity. A set of electrons can be accelerated near a crest if it arrives at the center of a main cavity (or buncher cavity) at a time that the electromagnetic standing wave has not yet attained a maximum amplitude at that cavity or is slightly past the maximum. For example, a set of electrons can be accelerated near a crest if it arrives at the center of a main cavity at a time that the electromagnetic standing wave is around 5° of RF phase or less away from the maximum, up to around 10° of RF phase, or up to around 15° of RF phase away from the maximum.

5.2 Systems and Methods for Interleaving Operation of a Standing Wave LINAC

Provided herein are methods and systems that can be used in an interleaving operation of a LINAC by (i) varying the electron gun voltage to vary the energy of the electrons injected from the electron gun into the accelerating structure of the LINAC (discussed in Section 5.2.1), or (ii) using a detunable side cavity comprising an activatable window (discussed in Section 5.2.2). A system operated using any combination of method (i) and method (ii) also is provided herein.

5.2.1 Electron Output Energy Control Using Electron Gun Voltage

In one aspect, provided herein are methods for interleaving operation of a standing wave LINAC, where a LINAC can be operated to successively emit electron beams at a first output energy and at a second output energy that is different from the first output energy. The method comprises applying a first electron beam current and a first voltage to an electron gun to cause it to inject a first set of electrons into the longitudinal passageway of the LINAC, and operating the LINAC to accelerate the first set of electrons to a first output energy by the electric field of the electromagnetic standing wave. The first set of electrons output from the LINAC can be directed at a target to generate a first beam of x-rays having energies in a first range of x-ray energies. The method can further comprise applying a second current and a second voltage to the electron gun to cause it to inject a second set of electrons into the longitudinal passageway of the LINAC, and operating the LINAC to accelerate the second set of electrons to a second output energy. The output second set of electrons can be directed at a target to generate a second beam of x-rays having energies in a second range of x-ray energies. In one embodiment, the first beam current and the second beam current can be alternated to result in output electrons having different or interleaved energies, and that can be used to produce x-rays of different x-ray energies.

5.2.1.1 Electron Gun

In the methods and systems provided herein, the electron gun can be any electron gun deemed suitable by one of skill. For example, the L3 electron gun assembly, model number M592 (L3 Communications Corporation, San Carlos, Calif.) can be used.

An electron gun emits a set of electrons (or an electron beam) at a specified kinetic energy. Typically, the electron gun comprises a thermionic cathode and an anode disposed across from the cathode along a common longitudinal axis. The thermionic cathode emits a stream of electrons. The electron gun also can comprise a focusing component to focus the stream of electrons. For example, a focus electrode can be used to shape the electric fields to focus the electron beam into a convergent beam with a minimal diameter appearing beyond the anode. In some electron guns, the focusing component can be a grid positioned between the anode and the thermionic cathode, which applies fields for controlling the diameter of the electron stream. Such a grid can have an aperture located concentric with the common longitudinal axis of the anode and cathode. In some electron guns, the grid can include an intercepting screen capable of turning the beam on and off and of controlling the beam current, depending on the voltage applied to the grid. The anode can also have an aperture concentric with the longitudinal axis. The diameter of the aperture of the anode can be smaller than the diameter of the cathode. A voltage applied to the grid and the anode relative to the cathode can produce a convergent axial electric field between the grid and the anode, that can cause a quasi-laminar flow of electrons having a constant current density that can increase from the cathode towards the anode. The accelerated electrons are emitted through the aperture of the anode.

Figure 2:
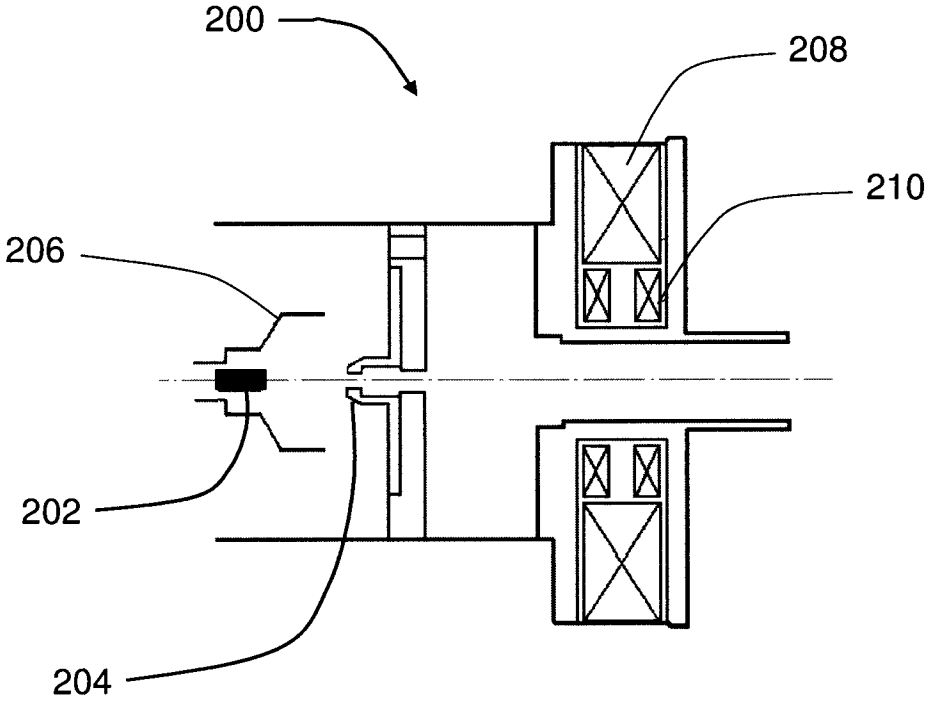
FIG. 2 shows a schematic of a cross-section of the electrodes, focusing and guiding coils of an electron gun.

An example of an electron gun is illustrated in FIG. 2. The electron gun 200 is a three-electrode Pierce-type electron gun, that comprises a cathode 202, an anode 204, and a focusing electrode 206. The cathode 202 can be heated by, for example, a filament. A voltage between the cathode and the anode accelerates the electrons emitted by the cathode towards the anode. The electron gun also includes a focusing coil 208 and a guiding coil 210. The focusing electrode 206, focusing coil 208 and guiding coil 210 act to compress the stream of electrons radially and guide it into the input aperture or input cavity that leads to the longitudinal passageway 10 of the LINAC. The anode also can include a mesh covering the anode hole to suppress electric field components that can defocus the stream of electrons in the region of the input aperture or input cavity if the mesh were absent.

In operation, the electron beam current and the voltage applied in the electron gun can be changed over a wide range. According to the systems and methods disclosed herein, the electron beam current and the voltage applied in the electron gun can be modified such that the electron gun emits a set of electrons (an electron beam) at the specified kinetic energy. In certain embodiments, the beam current can be decreased and the voltage applied to the electron gun can be reduced for the higher energy operation of the LINAC, i.e., to obtain an output of electrons at a higher energy. Reducing the electron beam current can reduce the dose rate (amount per unit time) of electrons ejected from the electron gun. In certain embodiments, an output of electrons at a higher energy can be obtained by decreasing both the electron beam current and the electron gun voltage.

5.2.1.2 Electron Gun Voltage Tuning

The systems and methods disclosed herein can be used to operate a standing wave LINAC to obtain a high dose rate of electrons at different energies in a multi-energy operation. The energy of the output electron beam can be changed by changing the amplitude of the electromagnetic standing wave in the LINAC, so as to exert greater or lesser acceleration on the set of electrons injected into the LINAC. The amplitude of the standing wave in the LINAC can be reduced by (i) reducing the power of the electromagnetic wave coupled into the LINAC, (ii) increasing the beam current from the electron gun (through the beam loading effect), or (iii) some combination of both (i) and (ii).

Conventionally, the injection gun current can be varied to change the energy of the electron beam from the electron gun through the beam loading effect. In the beam loading effect, the electron beam bunched at the resonant frequency of the LINAC can induce a standing wave in the LINAC that has a phase that opposes the acceleration applied by the electromagnetic wave coupled into the LINAC. That is, beam loading can induce fields that act to decelerate the electron beam. The amplitude of these induced fields vary linearly with the beam current. A higher electron beam current can induce electric fields of higher amplitude that oppose the acceleration applied by the electromagnetic wave coupled into the LINAC, and result in the electron beam experiencing less acceleration. The effect of beam loading is to decrease the amplitude of the electromagnetic wave. A desirable result of increasing the electron gun current (and hence the effect of beam loading) to lower the energy of the output electrons can be that the x-ray yield can be increased (for example, from the increased dose rate of electrons) in x-ray applications.

The change in amplitude of the electromagnetic standing wave occurs in both the buncher cavities and the accelerating cavities of the LINAC. When the amplitude of the electromagnetic wave is changed in the buncher cavities, the transit time of the electrons through the buncher region is also changed. This can cause the set of electrons to move off the crest of the electromagnetic wave, which can broaden the energy spectrum of the output electrons and can decrease energy stability. Thus, reducing the amplitude of the standing wave in the LINAC, such as by increasing the beam current (to exploit the beam loading effect) or by reducing the power of the electromagnetic wave coupled into the LINAC, can have a greater effect on electrons in the buncher cavities, and hence a greater effect on the energy spectrum and stability of the output electron beam. That is, since reducing the amplitude of the standing wave in the LINAC can cause the set of electrons to move off the crest of the electromagnetic wave, the electrons may not be optimally accelerated in the LINAC, resulting in broadening of the energy spectrum of the output electrons and a decrease in energy stability.

In the systems and methods disclosed herein, the electron gun voltage can be varied to move the set of electrons back to or nearer to the crest of the electromagnetic wave in order to improve the energy spectrum and the stability of the output electrons. Varying the electron gun voltage can vary the energy of the injected from the electron gun into the accelerating structure of the LINAC, which can compensate for the effect of reduced amplitude in the buncher cavities.

The injection gun voltage can be varied along with the electron gun beam current to optimize the energy spectrum and electron dose rate at different output energies. In the example of FIG. 2, a voltage applied to cathode 202 relative to anode 204 can be varied. That is, the voltage between the cathode and anode of the electron gun can be modified along with the electron gun beam current such that the electron bunch is accelerated in the main cavities on or near the crest of the electromagnetic wave. Operating a LINAC according to the methods disclosed herein can result in an output electron beam with improved energy spectrum and energy stability. In certain embodiments, lowering the gun voltage in a higher energy operation of the LINAC can improve the performance. For example, both the electron beam current and the electron gun voltage can be decreased to obtain a higher energy output electron beam from the LINAC with improved performance. The power level of the electromagnetic wave fed into the LINAC also can be varied to optimize the energy spectrum and electron dose rate at the different energies. With these methods, the range of available output energies can be extended for use in different applications of a LINAC, such as but not limited to, interleaving the different output energies of the LINAC for use in a radiographic application.

Figure 3:
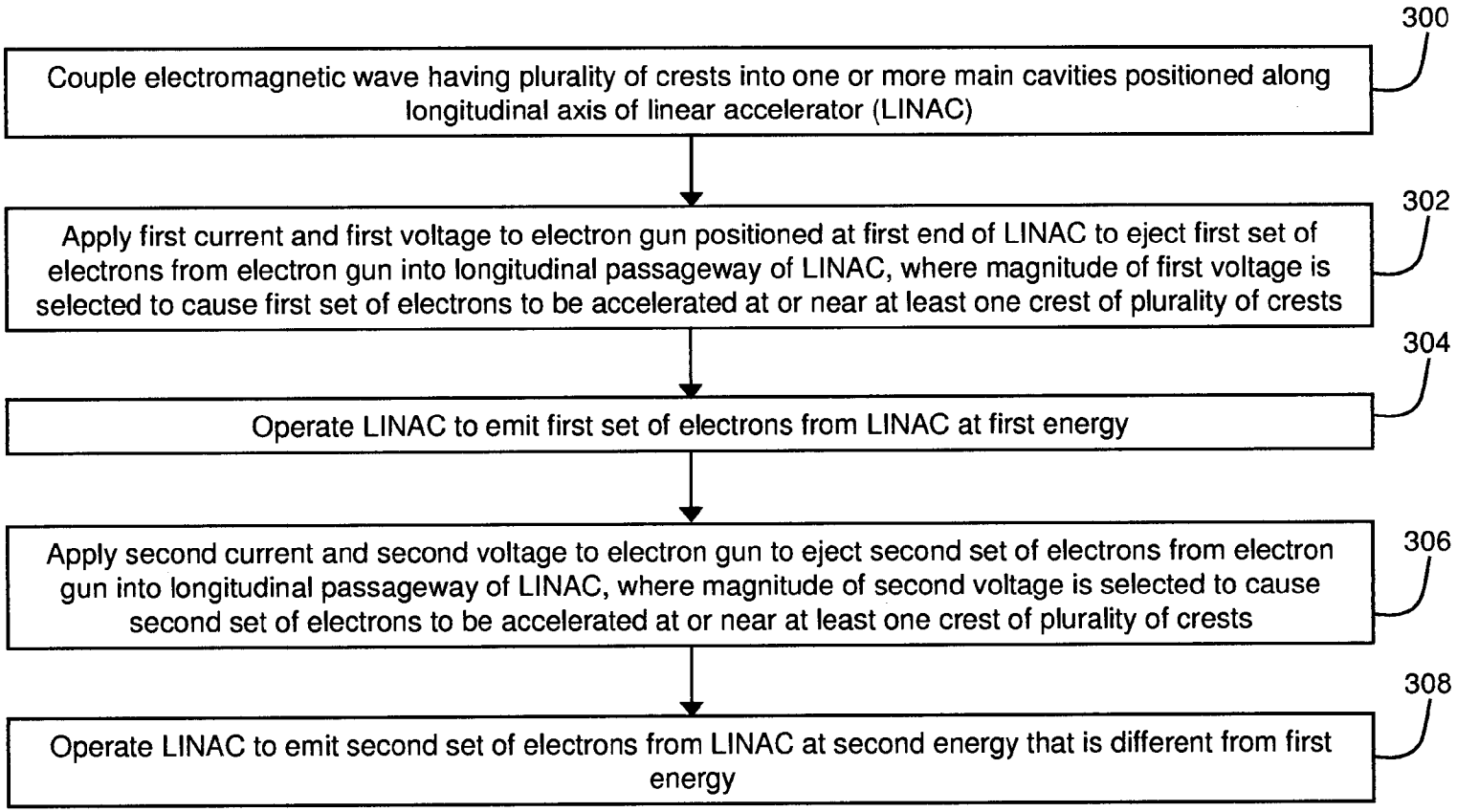
FIG. 3 shows a flow chart of the operation of an electron gun and a LINAC according to a first aspect.

5.2.1.3 Method for Generating a High Dose Rate of Electrons Using Electron Gun Voltage Tuning The flow chart of FIG. 3 shows steps in an example method for generating a high dose rate of electrons at multiple energies using a standing wave LINAC.

Figure 4:
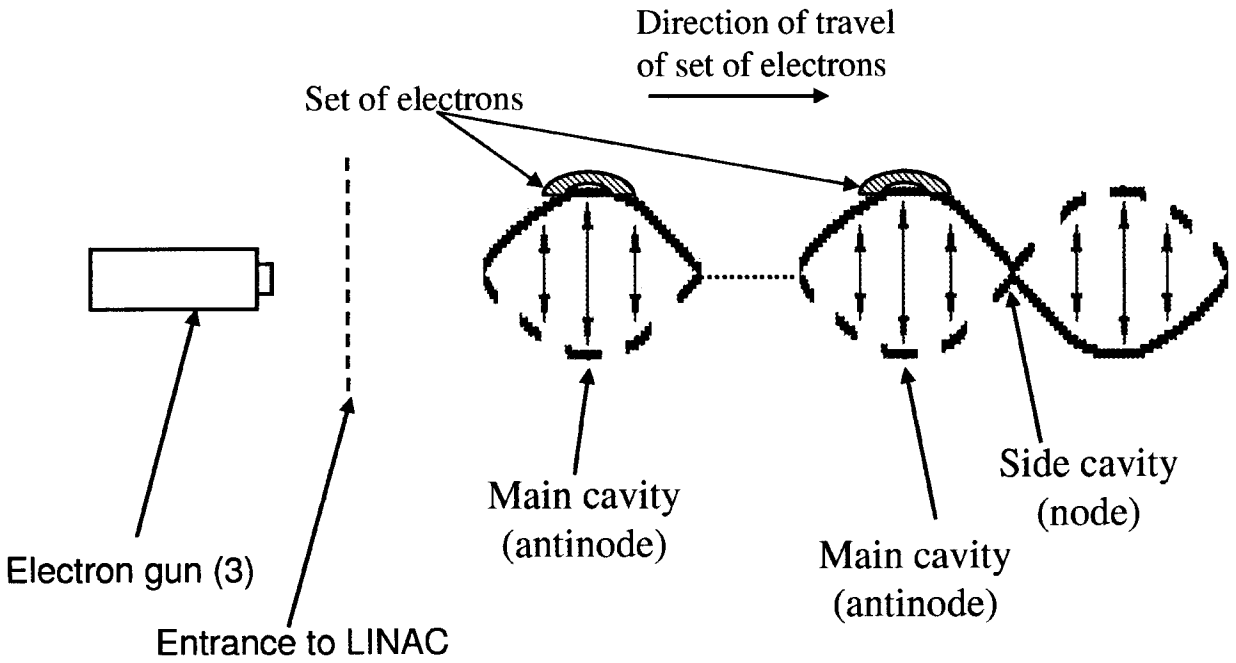
FIG. 4 shows an electron gun and a set of electrons relative to the standing wave of the LINAC.

Step 300. An electromagnetic wave is coupled into the LINAC to form a standing wave. The LINAC can be configured so that one or more of the crests of the electromagnetic wave accelerates electrons present in the region of the main cavities along the longitudinal axis of the LINAC. As illustrated in FIG. 4, the electromagnetic wave forms a standing wave in the LINAC such that the extrema of the electromagnetic wave (i.e., a maximum or minimum amplitude of the standing wave) occur at the main cavities.

Step 302. In step 302, a first set of electrons is ejected from an electron gun into the longitudinal passageway of the LINAC. FIG. 4 illustrates an electron gun 3 positioned near an entrance of a LINAC to inject a set of electrons into the longitudinal passageway of the LINAC. The magnitudes of the beam current and the gun voltage can be selected so that the first set of electrons is ejected at an initial energy and enters the LINAC when the electromagnetic wave has reached the desired value to accelerate the electrons to the desired energy. The first set of electrons is initially unbunched, so that the electrons enter the LINAC at all phases. The gun voltage can be selected so that the electromagnetic field in the buncher of the LINAC will bunch the electrons into a phase that is at or near the crest of the electromagnetic wave. FIG. 4 illustrates the set of electrons being accelerated by the electromagnetic standing wave at a main cavity of the LINAC. The first set of electrons experiences an approximately maximum magnitude of acceleration by virtue of being accelerated at or near the crest of the electromagnetic wave when the set of electrons arrive at each main cavity.

The gun current can be adjusted so as to control the accelerated beam current, and to control the amplitude of the electromagnetic wave in the LINAC via the beam-loading effect. The gun voltage can be adjusted so as to control the transit time of the electrons through the first cavity (e.g., buncher) of LINAC, and thus to control the phase of the bunch relative to the electromagnetic wave in the rest of the LINAC. FIG. 4 illustrates an example in which the set of electrons is accelerated at or near a crest of the electromagnetic standing wave at two main cavities. In an example, the magnitude of the voltage applied to the electron gun can be selected such that the first set of electrons is accelerated by substantially all of the crests of the plurality of crests of the standing wave.

In step 300, the power of the electromagnetic wave fed into the LINAC also can be changed so as to obtain the desired output energy of electrons from the LINAC when the electrons are at or near the crest of the standing wave. Specifically, change in the power of the electromagnetic wave changes the amplitude of the extrema of the electromagnetic standing wave (i.e., the maximum or minimum amplitude of the standing wave) that occurs at the main cavities. When the power of the electromagnetic wave is reduced, the amplitude of the extrema of the electromagnetic standing wave also is reduced, which can result in the first set of electrons experiencing a lower magnitude of acceleration at a given main cavity, thus reducing the electron energy at the output of the LINAC. The average current of the output electrons can also be controlled by adjusting the duty factor of the LINAC (pulse length times pulse repetition rate).

The time interval between steps 300 and 302 can be selected so that the first set of electrons is emitted at the desired dose rate at the first energy. In an example, step 300 is performed substantially simultaneously with step 302. Such simultaneous performance may be suitable, for example, in circumstances where the amplitude of the beam-induced fields are at least 80% of the amplitude of the unloaded steady state fields, or at least 90%, or at least 95%, or nearly 100% of the amplitude of the unloaded steady state fields. Alternatively, in other circumstances, step 302 may be performed at a suitable time following step 300. The injection of the set of electrons during step 302 can be timed during the rise time of the unloaded fields generated during step 300, to compensate for the beam loading and optimize the spectrum. For example, where the field strength is within about 1/e of the unloaded steady state field (e.g., where the amplitude of the beam-induced fields are about 30% of the amplitude of the unloaded steady state fields), step 302 may be delayed from step 300 by a time period sufficient to fill the longitudinal passageway of the LINAC with electrons. The electrons typically can travel the length of the LINAC within a few nanoseconds. However, it can take hundreds of nanoseconds or a few microseconds for the pulse of the electromagnetic wave coupled into the LINAC to rise to full amplitude and the fields in the LINAC to approach a steady state beam loaded value. An optimal output electron energy spectrum can be achieved if the electron beam is turned on when the electromagnetic fields in the LINAC have reached the steady state beam loaded value.

In step 304, the LINAC is operated to emit the first set of electrons from the LINAC at a first energy. As a non-limiting example, operating the standing wave LINAC can include operating the AFC. In an example, the output electrons at the first energy can be used in a procedure, such as but not limited to, a medical procedure. In another example, the first set of electrons output from the LINAC can be contacted with a target to generate a beam of x-rays having an energy in a first range of x-ray energies for use in a procedure, such as but not limited to, a medical procedure.

Step 306. In step 306, a second set of electrons is ejected from the electron gun into the longitudinal passageway of the LINAC. The magnitude of the beam current can be selected to change the amplitude of the electromagnetic wave through the beam loading effect, and the magnitude of the gun voltage can be selected to move the second set of electrons back to or nearer to the crest of the electromagnetic wave (discussed in Section 5.2.1.2). For example, as discussed above, the magnitude of the gun voltage can be selected so that the second set of electrons is accelerated by substantially all of the crests of the plurality of crests of the standing wave. Or, for example, as discussed above, the gun current can be selected so that the second set of electrons has a desired current at the output of the LINAC, and so as to control the amplitude of the electromagnetic wave in the LINAC via the beam-loading effect. The magnitudes of the beam current and/or the gun voltage to provide the second set of electrons can be different from the magnitudes of the beam current and/or gun voltage to provide the first set of electrons.

In certain embodiments, the first energy of the first set of electrons output from the LINAC has a central value that can be different from the central value of the second energy of the second set of electrons output from the LINAC. The central value of the energy of a set of electrons can be a median value or an average value of a range of output energies of the set of electrons. In one example, the median value of the range of output energies of a first set of electrons can be compared to the median value of the range of output energies of a second set of electrons. In another example, the average value of the range of output energies of the first set of electrons can be compared to the average value of the range of output energies of the second set of electrons. While the central value of the first energy can be different from the central value of the second energy, the range of energies of the first set of electrons can overlap the range of energies of the second set of electrons.

A second electromagnetic wave can be coupled into the LINAC after step 304 and prior to step 306. The power of this electromagnetic wave fed can be different from the power of the electromagnetic wave coupled into the LINAC in step 300, resulting in different respective output energies for the first and second sets of electrons output from the LINAC. In an example, the magnitude of the voltage applied to the electron gun can be selected so that the second set of electrons is accelerated by substantially all of the crests of the plurality of crests of the standing wave, the current applied to the electron gun can be selected so that the second set of electrons has a desired current at the output of the LINAC, and the power of the electromagnetic field can be selected so that the second set of electrons has a desired energy at the output of the LINAC.

In an example, the second set of electrons output from the LINAC can be contacted with a target, which generates a beam of x-rays from the target having x-ray energies in a second range of x-ray energies. The maximum value of x-ray energy of the range of first x-ray energies generated in step 302 can be different from maximum value of x-ray energy of the range of second x-ray energies generated in step 306.

In step 308, the LINAC is operated to emit the second set of electrons from the LINAC at a second energy that is different from the first energy. As a non-limiting example, operating the standing wave LINAC can include operating the AFC. In an example, the output electrons at the second energy can be used in a procedure, such as but not limited to, a medical procedure. In another example, the second set of electrons output from the LINAC can be contacted with a target to generate a beam of x-rays having an energy in a second range of x-ray energies for use in a procedure, such as but not limited to, a medical procedure.

In certain embodiments, the second energy can be higher than the first energy. In embodiments that include a diode gun or a non-intercepting grid, to emit the second set of electrons at the second energy, the beam voltage applied in step 306 can be reduced from the value applied in step 302, which can result in increased amplitude of the electronic wave because beam loading is less. The voltage in step 306 then can be reduced from the value applied in step 302, which can cause the second set of electrons to be accelerated at or nearer to the crest of the electromagnetic wave (see Section 5.2.1.2).

In a specific embodiment, to emit the second set of electrons at a second energy which is higher than the first energy, a second electromagnetic wave can be coupled into the LINAC after step 304 and prior to step 306 and, in addition to applying a reduced beam current and reduced gun voltage, the power of the second electromagnetic wave can be higher than the power of the electromagnetic wave coupled into the LINAC in step 300.

In certain embodiments, the second energy can be lower than the first energy. To emit the second set of electrons at the second energy, the gun current applied in step 306 can be increased from the value applied in step 302, which can result in reduced amplitude of the electronic wave because the beam loading effect is greater, resulting in a lower second energy. The voltage in step 306 also can be increased from the value applied in step 302, which can cause the second set of electrons to be accelerated at or nearer to the crest of the electromagnetic wave (see Section 5.2.1.2).

In a specific embodiment, to emit the second set of electrons at a second energy which is lower than the first energy, a second electromagnetic wave can be coupled into the LINAC after step 304 and prior to step 306. In addition to applying an increased beam current and increased gun voltage, as described immediately above, the power of the second electromagnetic wave can be selected to be lower than the power of the electromagnetic wave coupled into the LINAC in step 300, resulting in a lower second energy.

In an example, the first energy can be at or near the maximum attainable output energy of the LINAC and the second energy can be a lower energy than the first. In another example, the second energy can be at or near the maximum attainable output energy of the LINAC and the first energy can be a lower energy than the second.

The performance of steps 300 and 302 can be controlled by one or more control units. For example, one or more control units can be used to issue commands that set the magnitude of the current and the magnitude of the voltage applied to the electron gun. In examples in which the power of the electromagnetic wave can be varied, one or more control units can be used to issue commands that cause the change of the power of the electromagnetic wave. One or more controls can be used to issue commands to control the time interval between the performance of steps 300-308. For example, the control unit can in some embodiments instruct the electron gun to eject the first set of electrons (step 302) before the electromagnetic wave (step 300) has reached steady state in the LINAC. The one or more control units can receive instructions from a computer system (such as commands stored in computer memory), from a computer readable medium, or from a user through a user input device. The same control unit that issues commands for controlling the beam current and voltage of the electron gun also can issue commands for operating the other elements of the standing wave LINAC (such as, but not limited to, the timing of injection of the electrons from the electron gun, the coupling of the electromagnetic wave into the LINAC, and selection of the power of the electromagnetic wave). In another example, the control unit that issues commands for controlling the electron gun can be separate from the control unit that issues commands for operation of the LINAC. The control units can be in communication and synchronized in order to execute the steps of the method.

5.2.2 Electron Output Energy Control Using a Detunable Side Cavity Comprising an Active Side Window In another aspect, systems and methods disclosed herein can be used to operate a standing wave LINAC to obtain a high dose rate of electrons at different energies in a multi-energy operation. In this aspect, one or more detunable side cavities of the LINAC can be detuned to control the output energy of sets of electrons such that the LINAC can be operated to emit electron beams that alternate between a first output energy and a second output energy. The method comprises injecting a first set of electrons into the longitudinal passageway of the LINAC, accelerating the first set of electrons to a first output energy by the electric field of the electromagnetic standing wave, activating the one or more detunable side cavities to an activation state, injecting a second set of electrons into the longitudinal passageway, and accelerating the second set of electrons to a second output energy by the electric field of the electromagnetic standing wave. The power of the electromagnetic wave coupled into the LINAC also can be changed to accelerate the second set of electrons.

When the LINAC is operated to accelerate the first set of electrons to a first energy, the activatable window of the one or more detunable side cavities can be activated to a first activation state. When the LINAC is operated to accelerate the second set of electrons to a second energy, the activatable window of the one or more detunable side cavities can be activated to a second activation state that is different from the first activation state. In one embodiment, the activatable window can be set to a deactivated state for the first activation state and activated for the second activation state. In another embodiment, the activatable window can be set to a deactivated state for the second activation state and activated for the first activation state. The first set of electrons can be accelerated to a first energy. The second set of electrons can be accelerated to a second energy that is different from the first energy. The first energy and the second energy can differ in their central value, such as the median value or average value as described above.

5.2.2.1 Electron Output Energy Control Using an Activatable Window

Figure 5:
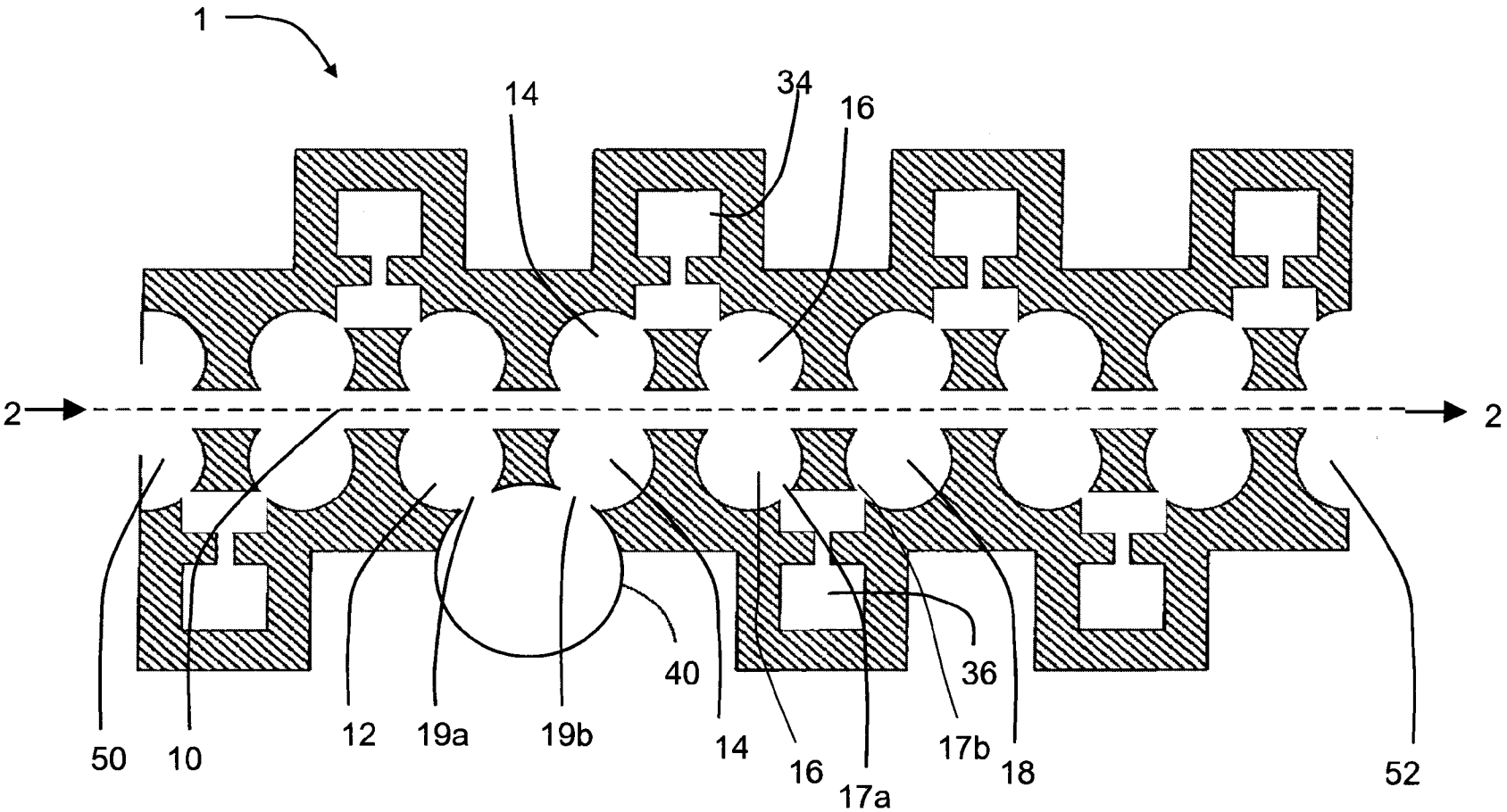
FIG. 5 shows a standing wave LINAC with a detunable side cavity positioned on a side of the LINAC.

Provided herein are standing wave LINACs comprising at least one detunable side cavity comprising an activatable window, and methods for their operation. FIG. 5 illustrates a LINAC comprising a number of side cavities. One of the side cavities is a detunable side cavity. The first type of side cavity, such as side cavity 36 shown in FIG. 5, couples adjacent main cavities 16 and 18 through apertures 17*a* and 17*b*. The second type of side cavity, a detunable side cavity such as side cavity 40 (see in FIG. 5), couples adjacent main cavities 12 and 14 through apertures 19*a* and 19*b*. As discussed in Section 5.2.2.2 below, detunable side cavity 40 comprises an activatable window that can be used to tune the output energy of the electrons emitted from the standing wave LINAC.

Figure 6A:
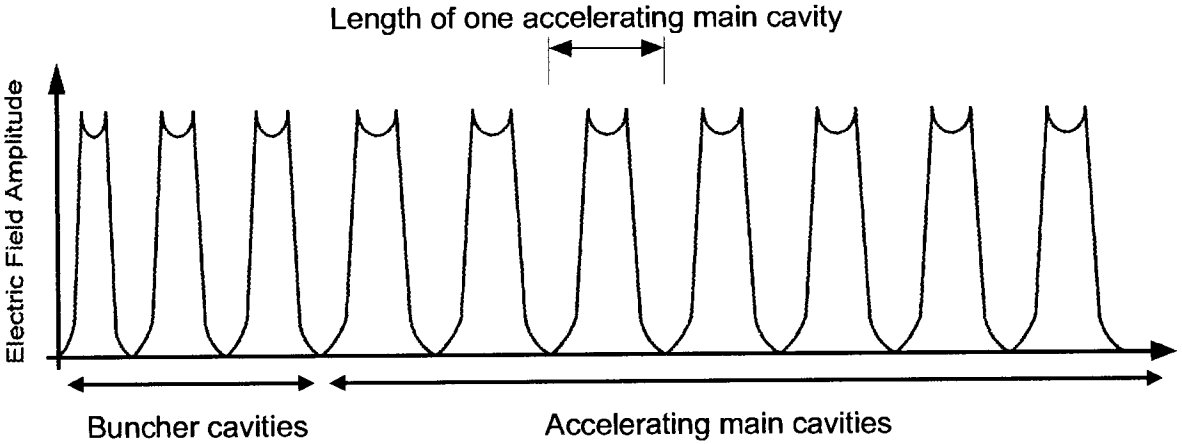
FIG. 6A shows a plot of the variation of the electric field amplitude in the accelerating main cavities of a standing wave LINAC.

If all of the main cavities 12, 14, 16, 18 are similar and approximately axially-symmetrical about the longitudinal passageway 10, and all of the side cavities are similar to side cavity 34 or side cavity 36, the electric field in each main cavity will be substantially the same as the field in the other main cavities. As a result, the electron beam 2 can experience a maximum of the electric field amplitude (and thus a maximum forward acceleration) in all of the main cavities. FIG. 6A shows the variation of the amplitude of the electric field that acts on an electron beam in each of the main cavities as a function of an axial position along the longitudinal passageway of the accelerating structure of the standing wave LINAC during an operation where the electrons are accelerated in every main cavity. The electron beam that is emitted from an exit cavity of the LINAC can be accelerated to an energy that is near the maximum attainable final output energy of the standing wave LINAC system.

If an output electron beam at a lower energy is desired, the standing wave at a downstream portion of the standing wave LINAC can be disrupted so that less acceleration acts on the electron beam. To accomplish this, an energy switch positioned in a side cavity, for example, a mechanical switch (see, e.g., U.S. Pat. No. 4,629,938), or an electronic switch (see, e.g., U.S. Pat. No. 7,112,924), can be used to disrupt the resonant coupling between two neighboring main cavities. That is, activating the energy switch can result in significantly reduced magnitude of the accelerating electric field in the main cavity downstream of the side cavity, while leaving the accelerating electric field in the upstream main cavity essentially unchanged. In certain embodiments, the power of the electromagnetic wave coupled into the LINAC also can be reduced to a level appropriate for the number of accelerating cavities that still support the standing wave after activation of the switch, and to maintain the electromagnetic fields in the buncher cavities at a favorable level. The buncher cavities work favorably over a fairly limited range of electromagnetic fields, and the bunching cavities may not function to accelerate the bunch of electrons appropriately (so that the electron bunch (set of electrons) rides at or near the crest of the electromagnetic wave in the accelerating main cavities of the LINAC) if the power of the electromagnetic field is not modified. If the bunch does not ride at or near the crest of the electromagnetic wave, the energy spectrum of the output electrons can become broadened and the energy stability can deteriorate.

Figure 6B:
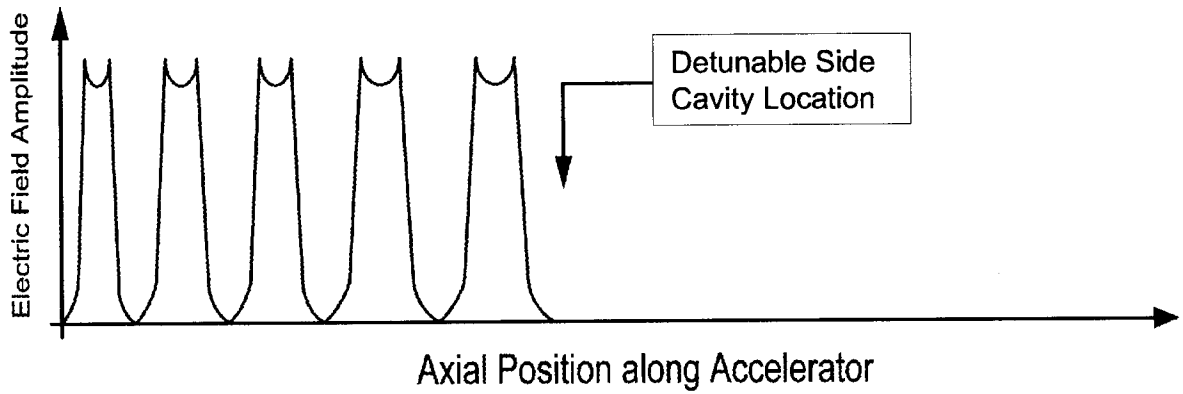
FIG. 6B shows a plot of the variation of the electric field amplitude in the accelerating main cavities of a standing wave LINAC in which an activatable window of a detunable side cavity has been activated.

An exemplary detunable side cavity 40 (illustrated in FIG. 5) can be activated to an activation state to disrupt the resonant coupling between neighboring main cavities 12 and 14, which can cause the electric field component of the electromagnetic wave in main cavities located downstream of the activated detunable side cavity to be significantly reduced, as discussed below in Section 5.2.2.2. As a result, an electric field having a distribution along the longitudinal axis of the accelerating structure similar to the plot shown in FIG. 6B can act on the electrons, resulting in the output from the standing wave LINAC of electrons at a lower energy. FIG. 6B illustrates the variation of the amplitude of the electric field that can act on the electron beam 2 in each of the main cavities as a function of an axial position along the longitudinal passageway of the accelerating structure of the standing wave LINAC accelerating structure during an operation where the activatable window of the detunable side cavity is detuned. The activatable window can be activated or de-activated to detune the detunable side cavity. The magnitude of the electric field component of the electromagnetic wave in main cavities located downstream of the detuned cavity can be significantly reduced. As a result, the electron beam can experience considerably less acceleration in these downstream main cavities and attain a lower final energy. The energy of the output electron beam emitted from the exit cavity of the LINAC can be lower than the maximum attainable energy of the standing wave LINAC system.

5.2.2.2 Detunable Side Cavities Comprising an Activatable Window

In this aspect, a detunable side cavity can comprise an activatable window that can be activated to tune or detune the resonant frequency of the detunable side cavity when the LINAC is being operated. In one mode of operation, the set of electrons can be accelerated by substantially the maximum attainable amplitude of the electric field of the electromagnetic wave in substantially all of the accelerating main cavities. In this mode, the activatable window is activated to an activation state that does not cause significant reduction of the electric field component of the electromagnetic wave in main cavities located downstream of the detunable side cavity comprising the activated switch. In another mode of operation, the set of electrons can be accelerated by substantially the maximum attainable amplitude of the electric field of the electromagnetic wave in fewer than all of the main cavities. In this mode, the activatable window can be activated to an activation state that causes significant reduction of the electric field component of the electromagnetic wave in main cavities located downstream of the detunable side cavity comprising the activated switch.

In this aspect, a detunable side cavity comprising an activatable window can be configured so that the detunable side cavity is tuned to sustain the resonant frequency of the standing wave LINAC when the activatable window is activated to a first activation state, while the detunable side cavity is tuned to disrupt the resonant frequency of the standing wave LINAC downstream of that side cavity when the activatable window is activated to a second activation state. That is, the detunable side cavity operates essentially as a node of the standing wave LINAC when the activatable window is in the first activation state, and is off-resonance when the activatable window is at a second activation state.

Figure 7B:
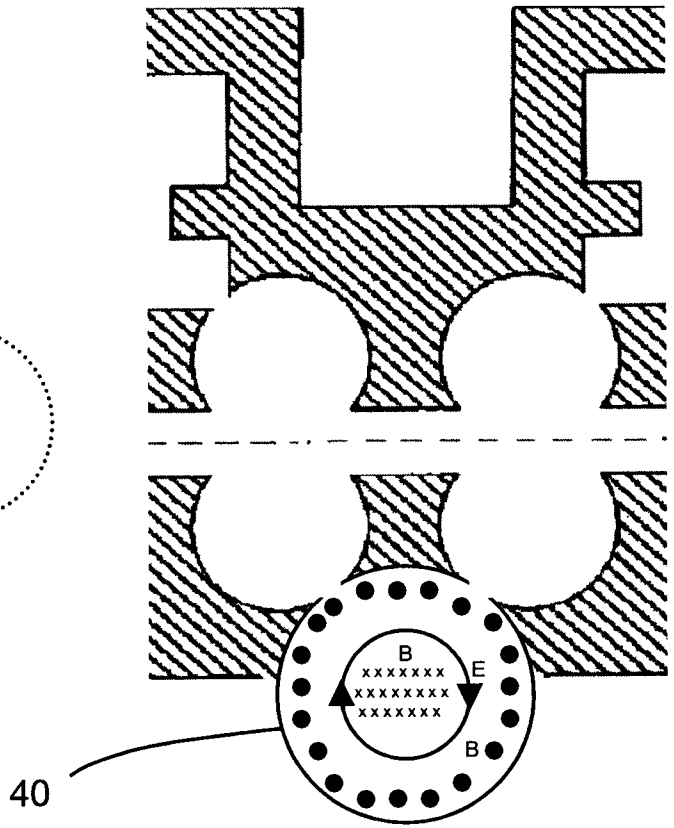
FIG. 7B shows a cross-section of a standing wave LINAC with a detunable side cavity comprising an activatable window positioned relative to the LINAC.
Figure 7A:
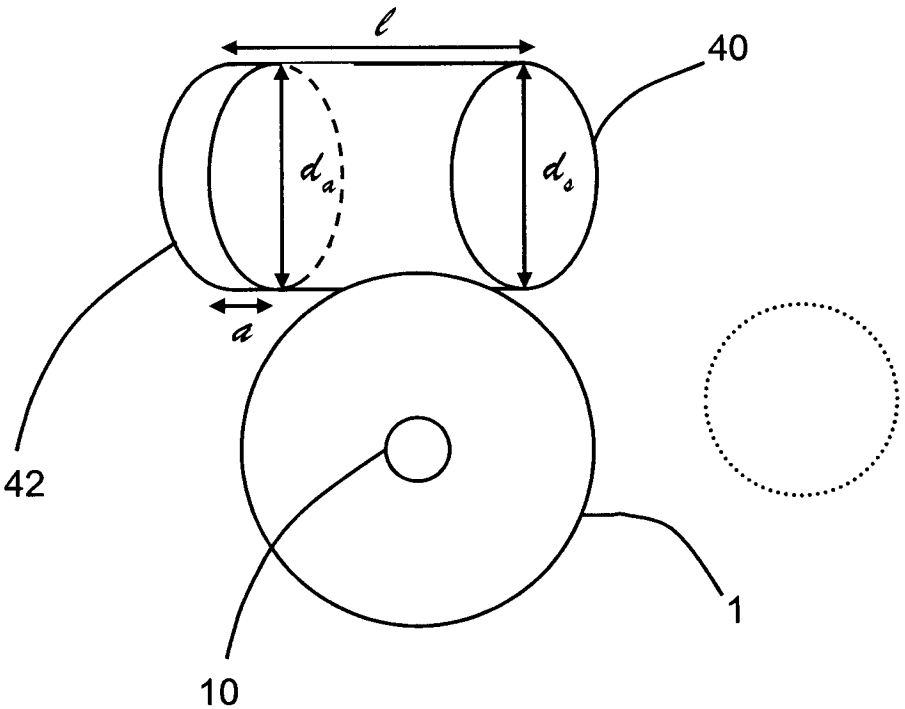
FIG. 7A shows a cross-section of a standing wave LINAC in a plane substantially perpendicular to the longitudinal axis of the LINAC, with a detunable side cavity comprising an activatable window positioned relative to the LINAC.

FIG. 7A shows an example of a detunable side cavity comprising an activatable window. In the illustration of FIG. 7A, the detunable side cavity has a substantially cylindrical cross-section of diameter $d_s$ and length l. Activatable window 42 can be positioned inside detunable side cavity 40 at a distance a from an end of the detunable side cavity 40. The space between the activatable window 42 and the distance a to the end of the detunable side cavity can contain a spacer material. In one example, the spacer material can be substantially transparent to the electromagnetic wave. Also, the spacer material can be a thermal conductor, for example but not limited to, indium, graphite, or a liquid metal. The activatable window of FIG. 7A has a substantially circular cross-section of diameter $d_a$. In the illustration of FIG. 7A, the diameter $d_a$ of the activatable window is approximately equal to the diameter $d_s$ of detunable side cavity. However, the activatable window can have a smaller diameter than the detunable side cavity. In this example, the activatable window can be separated from the walls of the detunable side cavity by a separator material. The separator material can be substantially transparent to the electromagnetic wave, and/or can be a thermal conductor, such as but not limited to, indium, graphite, or a liquid metal.

In another example, the activatable window can have a larger diameter than the detunable side cavity. In this example, electrical connections for activating the activatable window can be conducting traces on the surface of the activatable window. The TE01 mode (discussed below) is usually not disrupted by narrow slots in the wall of the detunable side cavity, since the currents in the wall of the detunable side cavity are azimuthal for the TE01 mode.

The walls of the detunable side cavity can comprise the same material as the other side cavities of the LINAC. For example, the walls of the detunable side cavity can include copper.

The detunable side cavity includes electrical connections (not shown) through which a current or a voltage can be applied to the activatable window in order to activate the activatable window. In one example, for the first activation state, the activatable window can be activated to become substantially transparent (i.e., substantially transmissive) to the electromagnetic wave supported by the detunable side cavity. A first current or first voltage can be applied to the activatable window to cause the activatable window to become substantially transparent (i.e., substantially transmissive). In the second activation state, the activatable window can be made substantially reflecting of, or opaque to, the electromagnetic wave supported by the detunable side cavity. A second current or second voltage can be applied to the activatable window to cause the activatable window to become substantially reflecting or opaque. The first current can be different from the second current; the first voltage can be different from the second voltage. In one example, the first energy can be the maximum attainable energy of the LINAC, and the second energy can be less than the maximum attainable energy of the LINAC. In another example, the second energy can be the maximum attainable energy of the LINAC, and the first energy can be less than the maximum attainable energy of the LINAC. In the foregoing embodiments, the activatable window can be activated by injecting charge carriers (such as electrons, holes, or ions) into a region of the activatable window.

In an example, the activatable window transmits more than 50% of a component of the electromagnetic wave guided mode coupled into the detunable side cavity when the activatable window is made transparent and transmits less than 50% of a component of the electromagnetic wave guided mode when the activatable window is made substantially reflecting of, or opaque to, the electromagnetic wave.

In one example, the length l of the detunable side cavity can be substantially a half-integer multiple of the guided wavelength $\lambda_g$ for the circular TE01 (transverse electric) mode of the electromagnetic wave that can be supported in the detunable side cavity due to its circular cross-section. That is, l can be around $\lambda_g/2$, $\lambda_g$, $3\lambda_g/2$, etc. The length l can differ from the half-integer multiple of the guided wavelength $\lambda_g$ by up to a few percentages of the value of $\lambda_g$, such as up to about 5% of $\lambda_g$ up to about 10% of $\lambda_g$. In this example, the detunable side cavity can be configured such that the detunable side cavity sustains the resonant frequency of the standing wave LINAC when the activatable window is at a first activation state that is substantially transparent to the circular TE01 mode of the electromagnetic wave. The set of electrons can be accelerated by an electric field distribution as shown in FIG. 6A, that is substantially similar in all of the accelerating cavities. The detunable side cavity can be tuned to disrupt the resonant frequency of the standing wave LINAC downstream of that side cavity when the activatable window is at a second activation state in which the activatable window becomes substantially reflecting of, or opaque to, the electromagnetic wave. Since the activatable window can be located a distance a from an end of the detunable side cavity, the length of the detunable side cavity can be essentially shortened when the activatable window becomes substantially reflecting of, or opaque to, the electromagnetic wave. The circular TE01 mode can be sustained if the detunable side cavity has a length that is essentially a half-integer multiple of the guided wavelength $\lambda_g$ of the circular TE01 mode of the electromagnetic wave. The shortening of the length of the detunable side cavity in the second activation state disrupts the TE01 mode, which disrupts the resonant frequency of the standing wave downstream of the side cavity. The set of electrons can be accelerated by an electric field distribution as shown in FIG. 6B, that is significantly reduced downstream of the detunable side cavity.

In an example where the activatable window has a larger diameter than the detunable side cavity, the TE01 mode may not be disrupted by narrow slots in the wall of the detunable side cavity, since the currents in the wall of the detunable side cavity are azimuthal for the TE01 mode.

In another example, the length l of the detunable side cavity can be longer than a half-integer multiple of the guided wavelength $\lambda_g$ for the circular TE01 mode of the electromagnetic wave. The activatable window can positioned at a distance a from an end of the detunable side cavity such that the length l-a is longer than a half-integer multiple of the guided wavelength $\lambda_g$ for the circular TE01 mode. That is, l-a can be $\lambda_g/2$, $\lambda_g$, $3\lambda_g/2$, etc. In this example, the detunable side cavity can be configured such that the detunable side cavity sustains the resonant frequency of the standing wave LINAC when the activatable window is at a first activation state that is substantially reflecting of, or opaque to, the circular TE01 mode of the electromagnetic wave. The set of electrons can be accelerated by an electric field distribution as shown in FIG. 6A, that is substantially similar in all of the accelerating cavities. In the second activation state, the activatable window can be made substantially transparent to the electromagnetic wave. Since, in this example, the length l is longer than a half-integer multiple of the guided wavelength $\lambda_g$ for the circular TE01 mode, the length of the detunable side cavity is essentially lengthened when the activatable window becomes substantially transparent. The lengthening of detunable side cavity in the second activation state disrupts the TE01 mode, which disrupts the resonant frequency of the standing wave LINAC downstream of the side cavity. The set of electrons can be accelerated by an electric field distribution as shown in FIG. 6B, that is significantly reduced downstream of the detunable side cavity.

As illustrated in FIG. 7B, the circular TE01 mode of the electromagnetic wave that is sustained in the substantially cylindrical detunable side cavity has a magnetic field (B) that is directed along the longitudinal axis of the detunable side cavity (for example, the B field is directed into the page near the center of the side cavity and is directed out of the page near the sides of the cavity) and an electric field (E) that is azimuthal. As shown in the examples of FIGS. 7A and 7B, the longitudinal axis of the detunable side cavity is oriented perpendicular to the longitudinal axis of the LINAC, so that the resonant frequency of the standing wave LINAC is sustained when the circular TE01 mode of the electromagnetic wave is sustained.

Figure 8A:
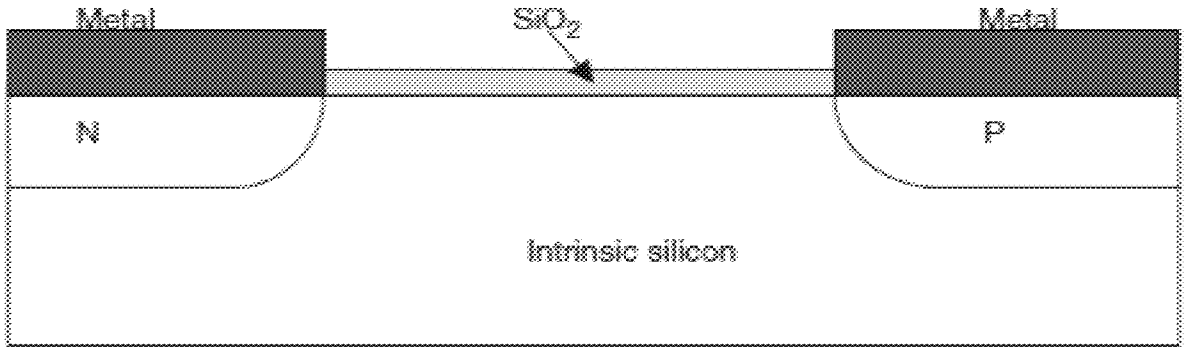
FIG. 8A shows a cross-section of a PIN diode of a silicon activatable window.
Figure 8B:
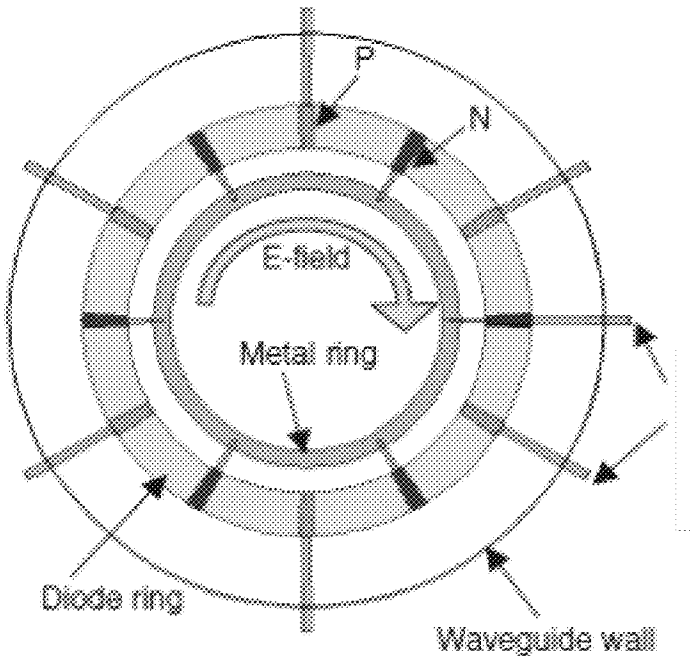
FIG. 8B shows a top view of a silicon activatable window comprising a number of PIN diodes.

The activatable window can be any activatable window deemed suitable to those of skill. In an example, the activatable window can be a doped silicon wafer window, such as but not limited to an activatable window comprising a number of PIN diodes on a silicon wafer. The activatable window can be activated by injection of charge carriers, such as electrons, holes, or ions, into a region of the activatable window. FIG. 8A illustrates a cross section of the activatable window along a line showing the n-doped region (donor-doped) and the p-doped (acceptor-doped) region of a PIN diode, the metal contacts, $SiO_2$ insulating region, that are patterned onto the intrinsic silicon wafer. FIG. 8B shows the diode ring and metal ring of the activatable window. Such an activatable window is disclosed in Guo et al., *New Journal of Physics* 8 (2006) 293 (which is incorporated herein by reference in its entirety), where it is placed at the junction between a RF source and an accelerator to act as an iris for controlling the active compression of RF pulses from the RF source. When a current is applied to the metal lines of the activatable window, an excess of charge can build up near the center of the activatable window. FIG. 8B shows the direction of the electric (E) field due to charge build-up on the activatable window. The excess of charge has a plasma frequency that effectively reflects the electromagnetic wave at the activatable window, and thus the build up of excess charge causes the activatable window to reflect the electromagnetic wave. Thus, to a TE01 mode, the activatable window appears to be a conductor or short circuit changing the resonant frequency of the detunable side cavity.

In an example where the activatable window is doped silicon wafer, such as but not limited to a silicon wafer comprising PIN diodes, the detunable side cavity can comprise a resonant TE01 substantially cylindrical waveguide of length $\lambda_g/2$ or a guided wavelength ($\lambda_g$). A round "active" doped silicon wafer window can be placed near one end. When the activatable window is activated to the "on" state by applying a current, the window has 1.6% loss and a 97% transmission coefficient. When the window is turned on by injecting charge carriers through a large number of PIN diodes arranged around the periphery of the window, the transmission drops to less than 1% (i.e., the activatable window becomes essentially opaque or reflecting) and the power loss rises to about 10%. To achieve this, about 70 pC of carriers can be injected, for example, by applying 10 s of amps of current over a period of several μsec before LINAC is operated to accelerate a set of electrons. Because the currents in the TE01 mode in the detunable side cavity are all azimuthal, the guide can be mounted with its axis transverse (perpendicular) to the LINAC, nestled between two of the LINAC accelerating cavities. The coupling slots between the LINAC cavities and the detunable side cavity are longitudinal in the TE01 mode and azimuthal in the LINAC cavities. When the silicon wafer window is switched from "off" (not activated) to "on" (activated), the detunable side cavity is detuned, because the detunable side window is effectively shortened by the reflection from the window.

While the detunable side cavity comprising the activatable window is illustrated as having a cylindrical cross-section, the detunable side cavity can have other morphologies. For example, the detunable side cavity can have a substantially rectangular, square, triangular, oval, or polygonal cross-section. For each of these different morphologies, the detunable side cavity can be positioned relative to the LINAC such that the detunable side cavity operates like a "node" of the LINAC for a first activation state of the activatable window, and disrupts the standing wave in the LINAC downstream of the detunable side cavity for a second activation state of the activatable window. Furthermore, the type of guided modes that can be sustained in the different detunable side cavity morphologies would be apparent to one skilled in the art. For example, for a TE10 mode or a TM11 (transverse magnetic) mode, a number of small holes in a transverse plane could be provided to bring in current carrying support pins to the activatable window.

Figure 17:
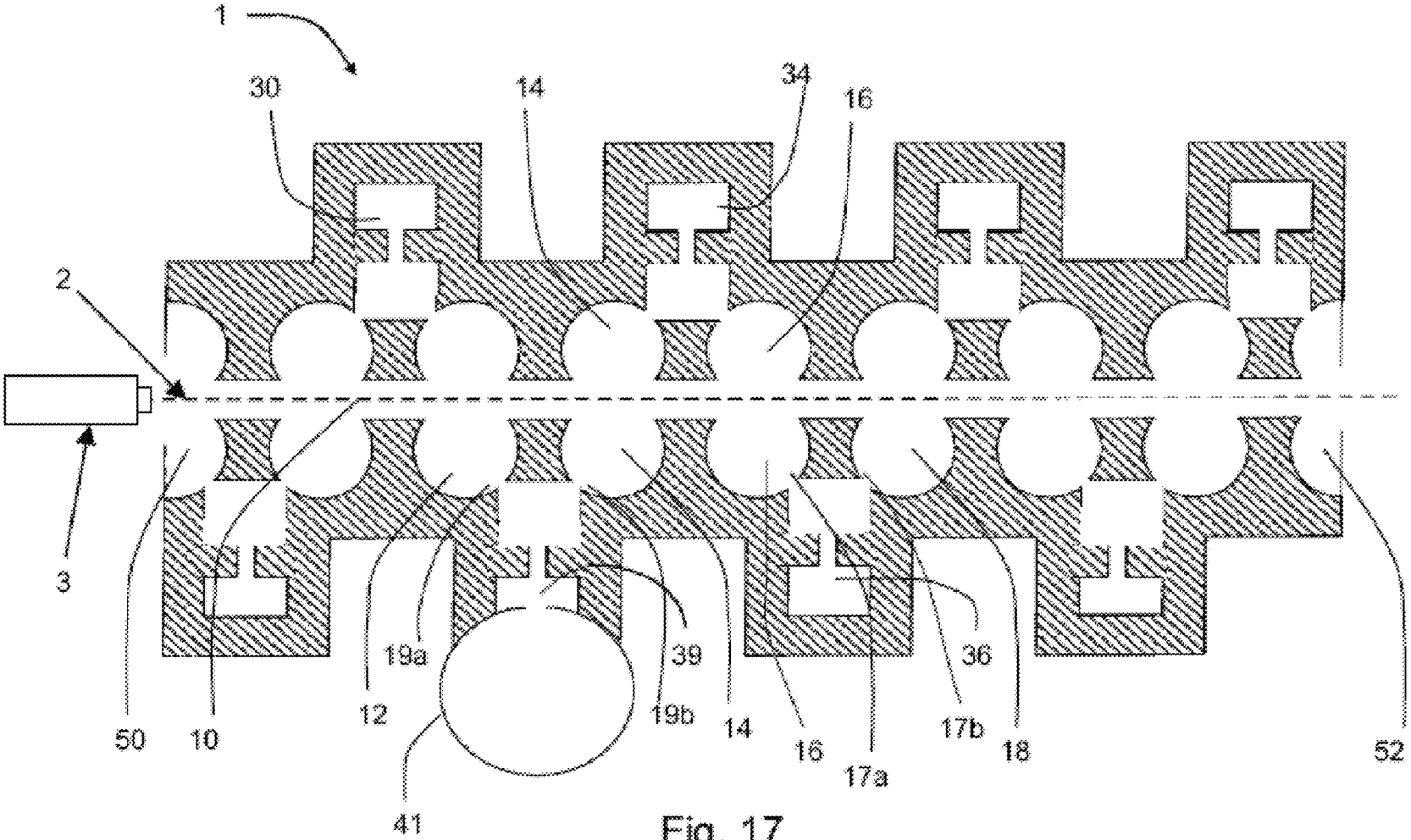
FIG. 17 shows another example of a standing wave LINAC with a detunable side cavity positioned on a side of the LINAC.

In another example, the detunable side cavity comprising an activatable window can be positioned and configured as illustrated in FIG. 17. That is, the detunable side cavity 41 can be positioned such that it does not communicate with the main cavities (such as to detunable side cavity illustrated in FIG. 5), but rather communicates another portion 39 of the side cavity. All of the foregoing descriptions relative to a detunable side cavity (such as detunable side cavity 40) also can be applicable to detunable side cavity 41.

In operation of a LINAC in which a switch of a side cavity is implemented, the switch (such as the activatable window of the detunable side cavity) can be activated prior to a pulse, the electromagnetic wave can then be fed into the LINAC from a source, and then a set of electrons can be injected by an electron gun into the longitudinal passageway of the LINAC. In certain embodiments, the injection of the set of electrons can be timed during the risetime of the unloaded fields to compensate for beam loading and optimize the spectrum. After the end of the pulse, the switch can be returned to a standby state (such as deactivating the activatable window). In certain embodiments where the pulse of the set of electrons from the electron gun is shorter than the pulse of the electromagnetic wave, it can be advantageous to deactivate the switch (such as deactivating the activatable window) after the gun pulse ends.

Figure 9:
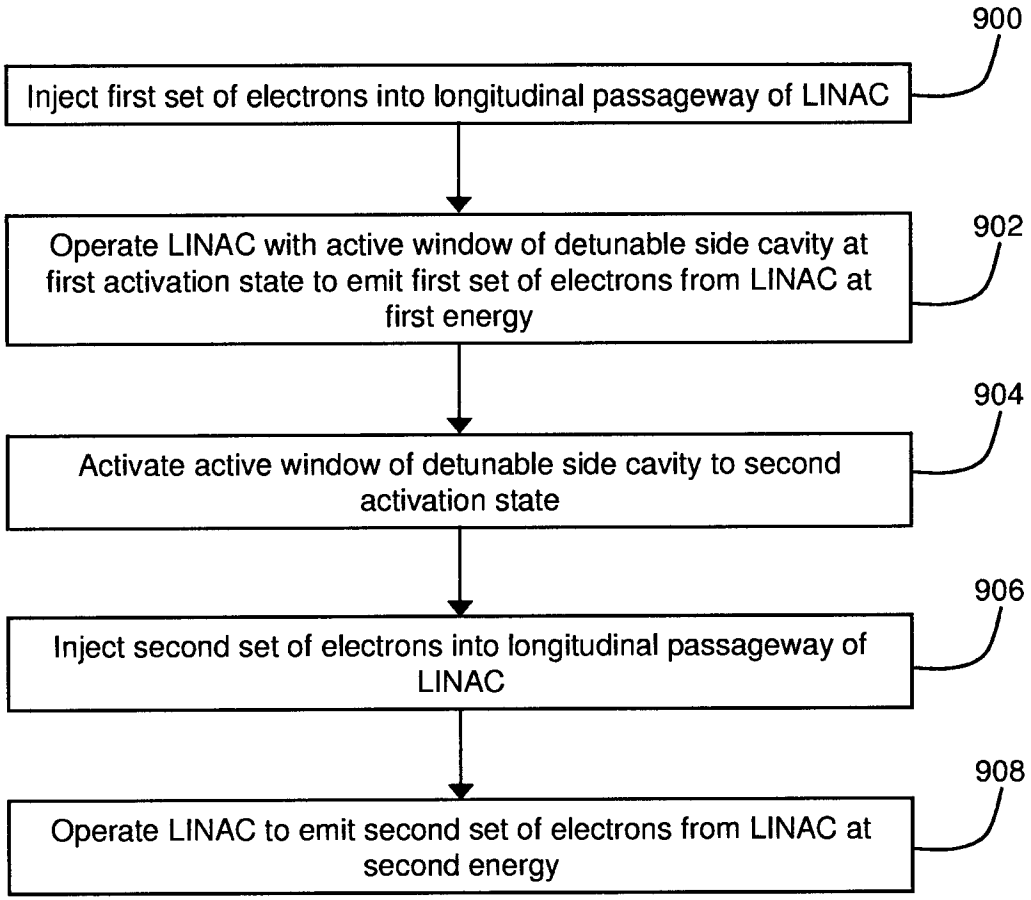
FIG. 9 shows a flow chart of the operation of a LINAC according to a second aspect.

FIG. 9 shows a flow chart of the operation of a LINAC that includes a detunable side cavity. The performance of steps 900 to 908 can be controlled by one or more control units. In step 900 of FIG. 9, a command is issued to the electron gun to inject a first set of electrons into longitudinal passageway 10 of the LINAC. Prior to step 900, a command can be issued to activate the activatable window of the detunable side cavity to a first activation state and to feed an electromagnetic wave into the LINAC. In step 902, a command is issued to operate the LINAC so that the first set of electrons is emitted from the LINAC at a first energy. The time interval between steps 900 and 902, and the order of the steps, can be selected to result in the first set of electrons being emitted at the desired dose rate and first energy. In step 904, a command is issued to activate the activatable window of the detunable side cavity to a second activation state, which decouples the portions of the LINAC downstream of the detunable side cavity, substantially reducing the accelerating electric field in the decoupled regions of the LINAC. After step 904 and prior to step 906, a command can be issued to couple an electromagnetic wave into the LINAC. In step 906, a command is issued to the electron gun to inject a second set of electrons into longitudinal passageway 10. The second set of electrons can be accelerated by substantially the maximum attainable amplitude of the electric field of the electromagnetic wave in the main cavities upstream of the detunable side cavity, and be accelerated by the reduced accelerating electric field in the decoupled regions downstream of the detunable side cavity. In step 908, a command is issued to operate the LINAC so that the second set of electrons can be emitted from the LINAC at a second energy that is different from the first energy.

In a specific embodiment, both the first set of electrons and the second set of electrons can be emitted from the LINAC in a single pulse of the electromagnetic wave. A command can be issued to inject the first set of electrons into the LINAC (step 900) during the filling time of the electromagnetic wave into the LINAC to achieve, almost immediately, the beam loaded steady state. Prior to step 900, the activatable window of the detunable side cavity can be activated to a first activation state that detunes the detunable side cavity. The first set of electrons is emitted from the LINAC at a first energy. In step 904, the activatable window of the detunable side cavity can then be activated to a second activation which does not detune the detunable side cavity, which can raise the electromagnetic fields in the main cavities downstream of the detunable side cavities. A command can be issued to inject the second set of electrons into the LINAC (step 906) while the electromagnetic fields in the downstream region of the LINAC are still rising, so that the beam energy can achieve, almost immediately, the beam loaded steady state. The second set of electrons is emitted from the LINAC at a second energy which is higher than the first energy.

A system according to this aspect also can comprise more than one detunable side cavity. In operation of this LINAC, to emit the second set of electrons at a second energy, the activatable windows of the two or more detunable side cavities can be activated substantially simultaneously to achieve advantageously low heating of the detunable side cavity. Two or more activatable windows can be activated substantially simultaneously if they are all activated within a time interval on the order of microseconds. For example, the activatable windows can be activated within a few hundred nanoseconds, a few microseconds, or tens or hundreds of microseconds of each other. In another example, the two or more activatable windows can be activated within about 10 microseconds or less of each other. In certain embodiments, the two or more activatable windows can all be activated within a time interval of less than about a microsecond of each other.

In certain embodiments, a standing wave LINAC can be operated in an interleaving operation to emit sets of electrons at two or more different output energies (i.e., different central values) using a combination of (i) varying the beam current and the gun voltage according to the methods discussed in Section 5.2.1, and (ii) using a detunable side cavity comprising an activatable window according to the methods discussed in Section 5.2.2.

5.3 X-Rays

X-rays are generated from the bombardment of a target material by the accelerated electron beam or electron bunches from a LINAC. The x-rays can be generated from a target through two different mechanisms. In the first mechanism, collision of the electrons from the LINAC an atom of a target can impart enough energy so that electrons from the atom's lower energy levels (inner shell) escape the atom, leaving vacancies in the lower energy levels. Electrons in the higher energy levels of the atom descend to the lower energy level to fill the vacancies, and emit their excess energy as x-ray photons. Since the energy difference between the higher energy level and the lower energy level is a discrete value, these x-ray photons appear in the x-ray spectrum as sharp lines (called characteristic lines). In the second mechanism, the electron beams or bunches from the LINAC are scattered by the strong electric field near the atoms of the target and give off bremsstrahlung radiation. Bremsstrahlung radiation produces x-rays photons in a continuous spectrum, where the intensity of the x-rays increases from zero at the energy of the incident electrons. That is, the highest energy x-ray that can be produced by the electrons from a LINAC is the highest energy of the electrons when they are emitted from the LINAC. The bremsstrahlung radiation can be of more interest than the characteristic lines for many applications.

Materials useful as targets for generating x-rays include tungsten, certain tungsten alloys (such as but not limited to tungsten carbide, or tungsten (95%)-rhenium (5%)), molybdenum, copper, platinum and cobalt.

5.4 Instrumentation

Certain instruments that can be used in operation of a standing wave LINAC include a modulator and an electromagnetic wave source.

5.4.1 Modulator

A modulator generates high-voltage pulses lasting a few microseconds. These high-voltage pulses can be supplied to the electromagnetic wave source (discussed in Section 5.4.3 below), to the electron gun (see Section 5.4.1), or to both simultaneously. A power supply provides DC voltage to the modulator, which converts this to the high-voltage pulses. For example, the Solid State Magnetron Modulator-M1 or -M2 (ScandiNova Systems AB, Uppsala, Sweden) can be used in connection with a magnetron. In another example, the Solid State Klystron Modulator-K1 or -K2 (ScandiNova Systems AB, Uppsala, Sweden) can be used in connection with a klystron.

5.4.2 Microwave Generators

The electromagnetic wave source can be any electromagnetic wave source deemed suitable by one of skill. The electromagnetic wave source (in the microwave of radio frequency ("RF") range) for the LINAC typically is either a magnetron oscillator or a klystron amplifier. In both types of instruments, the size of the RF source and the power output capability are roughly proportional to the wavelength of the electromagnetic wave. The electromagnetic wave can be modified by changing its amplitude, frequency, or phase.

5.4.2.1 Magnetron

A magnetron functions as a high-power oscillator, to generate microwave pulses of several microseconds duration and with a repetition rate of several hundred pulses per second. The frequency of the microwaves within each pulse is typically about 3,000 MHz (S-band) or about 9,000 MHz (X-band). For very high peak beam currents or high average currents, 800 to 1500 MHz (L-band) pulses can be used. The magnetron can be any magnetron deemed suitable by one of skill. For example, the CTL)(band pulsed magnetron, model number PM-1100X (L3 Communications, Applied Technologies, Watsonville, Calif.) can be used. Typically, the magnetron has a cylindrical construction, having a centrally disposed cathode and an outer anode, comprising resonant cavities machined out of a solid piece of copper. The space between the cathode and the anode is evacuated. The cathode is heated by an inner filament, and the electrons are generated by thermionic emission. A static magnetic field is applied perpendicular to the plane of the cross-section of the cavities, and a pulsed DC electric field is applied between the cathode and the anode. The electrons emitted from the cathode are accelerated toward the anode by the action of the pulsed DC electric field and under the influence of the magnetic field. Thus, the electrons move in a complex spiraling motion towards the resonant cavities, causing them to radiate electromagnetic radiation at a frequency in the microwave. The generated microwave pulses are fed to an accelerator structure via a transfer waveguide. Magnetrons typically operate at 1 or 2 MW peak power output to power low-energy LINACs (6 MV or less). Magnetrons can be relatively inexpensive and can be made compact, which is advantageous for many applications, but can have limited output power and limited lifetime, and can provide relatively limited control over the electromagnetic wave frequency and phase. Continuous-wave magnetron devices can have an output power as high as about 100 kW at 1 GHz with efficiencies of about 75-85 percent while pulsed devices can operate at about 60-77 percent efficiency. Magnetrons can be used in single-section low energy linear accelerators that may not be sensitive to phase. The magnetron is usually used with a feedback system to stabilize the microwave output.

5.4.2.2 Klystron

The klystron can be any klystron deemed suitable by one of skill. For example, the CPI S-band pulsed klystron, model number VKS-15 8262G (Communications and Power Industries (CPI), Palo Alto, Calif.) can be used. A klystron acts as an amplifier by converting the kinetic energy of a DC electron beam into microwave power. A beam of electrons produced by a thermionic cathode (a heated pellet of low work function material) is accelerated by high voltage electrodes (typically in the tens to hundreds of kilovolts). This beam of electrons is then passed through an input cavity. Microwave is fed into the input cavity of the klystron at, or near, the natural resonant frequency of the klystron cavity. The electric field of the microwave causes the previously continuous electron beam to form bunches at the input frequency. To reinforce the bunching, a klystron can contain additional buncher cavities. The microwave frequency current carried by the electron beam produces a microwave frequency magnetic field, which in turn excites a voltage across the gap of subsequent resonant cavities that can further bunch the beam. In the output cavity, the developed microwave power is coupled out of the klystron. The spent electron beam, having reduced energy, is captured in a collector. The klystron acts as an amplifier, because the output power of the microwave from a klystron can be much larger (typically 50 to 60 db) than the microwave input power, resulting in the amplified microwave power that can be phase stable with respect to the microwave input power. Since it is an amplifier, a klystron can be agile in changing the frequency and amplitude of the output microwave.

5.5 Exemplary Apparatus and Computer-Program Implementations

Aspects of the methods disclosed herein can be performed using a computer system, such as the computer system described in this section, according to the following programs and methods. For example, such a computer system can store and the issue commands to facilitate application of a current and/or a voltage to the electron gun to cause the electron gun to eject a set of electrons according to the methods disclosed herein. In another example, a computer system can store and issue commands to facilitate activation of an activatable window of a detunable side cavity according to the methods disclosed herein. The systems and methods may be implemented on various types of computer architectures, such as for example on a single general purpose computer, or a parallel processing computer system, or a workstation, or on a networked system (e.g., a client-server configuration such as shown in FIG. 10).

Figure 10:
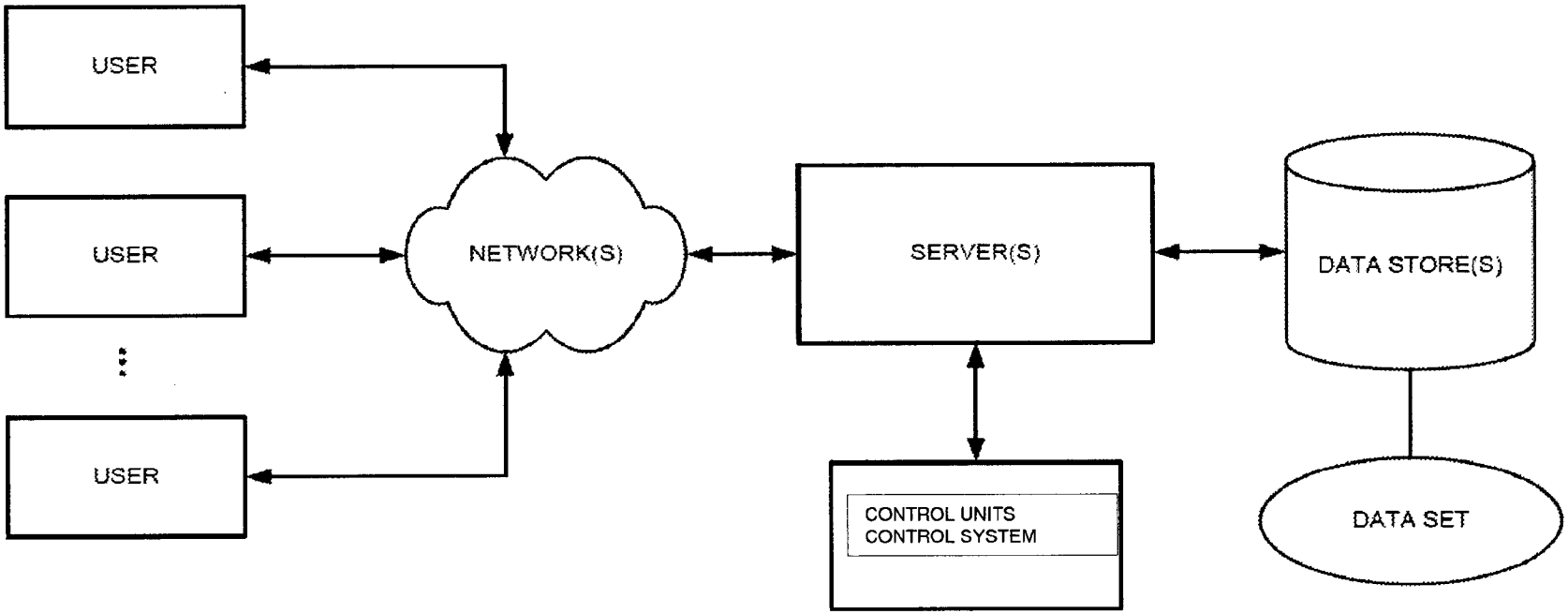
FIG. 10 illustrates an example computer system for use in implementing the methods.

An exemplary computer system suitable for implementing the methods disclosed herein is illustrated in FIG. 10. As shown in FIG. 10, the computer system to implement one or more methods and systems disclosed herein can be linked to a network link which can be, e.g., part of a local area network ("LAN") to other, local computer systems and/or part of a wide area network ("WAN"), such as the Internet, that is connected to other, remote computer systems. A software component can include programs that cause one or more processors to issue commands to one or more control units, which cause the one or more control units to issue commands to cause the electronic switches to activate to an activation state, to cause the electron gun to inject a first set of electrons into the longitudinal passageway of the LINAC, and to operate the LINAC (including commands for coupling the electromagnetic wave into the LINAC, and initiating the AFC). For example, the system can accept commands to cause the one or more control units to activate one or more activatable windows to an activation state which decouples the portions of the LINAC downstream of the detunable side cavities (as discussed above). The programs can cause the system to retrieve commands for executing the steps of the methods in specified sequences and at specified time intervals between the steps, from a data store (e.g., a database). Such a data store can be stored on a mass storage (e.g., a hard drive) or other computer readable medium and loaded into the memory of the computer, or the data store can be accessed by the computer system by means of the network.

In addition to the exemplary program structures and computer systems described herein, other, alternative program structures and computer systems will be readily apparent to the skilled artisan. Such alternative systems, which do not depart from the above described computer system and programs structures either in spirit or in scope, are therefore intended to be comprehended within the accompanying claims.

6. RESULTS

Certain results have been discussed previously. This section provides additional results or further discusses some of the results already discussed hereinabove.

6.1 Generation of a High Dose Rate of Electrons at Different Energies Using Electron Gun Voltage Tuning The injection gun voltage of the electron gun is varied along with the gun current to optimize the energy spectrum and electron dose rate of the electrons that are output at the different output energies. Table I lists operating parameters of the measurement, including the gun current (I) and gun voltage (V) applied to the electron gun, power level of the electromagnetic wave fed into the LINAC, and the average energy of the set of electrons output from the LINAC.

TABLE I

| RF (MW) to LINAC | Gun-I (mA) | Gun-V (kV) | Collected Beam-I (mA) | Beam Capture (%) | Average Energy (MeV) | Energy Spread FWHM (%) |
|---|---|---|---|---|---|---|
| 1.6 | 500 | 14.28 | 72 | 14.4 | 7.3 | 15 |
| 2.2 | 246 | 10 | 57 | 23.1 | 9.18 | 27.3 |
| 2.2 | 236 | 8 | 43.9 | 18.6 | 9.60 | 14.2 |
| 2.2 | 220 | 6 | 16.4 | 7.5 | 10.91 | 10.9 |

Figure 11:
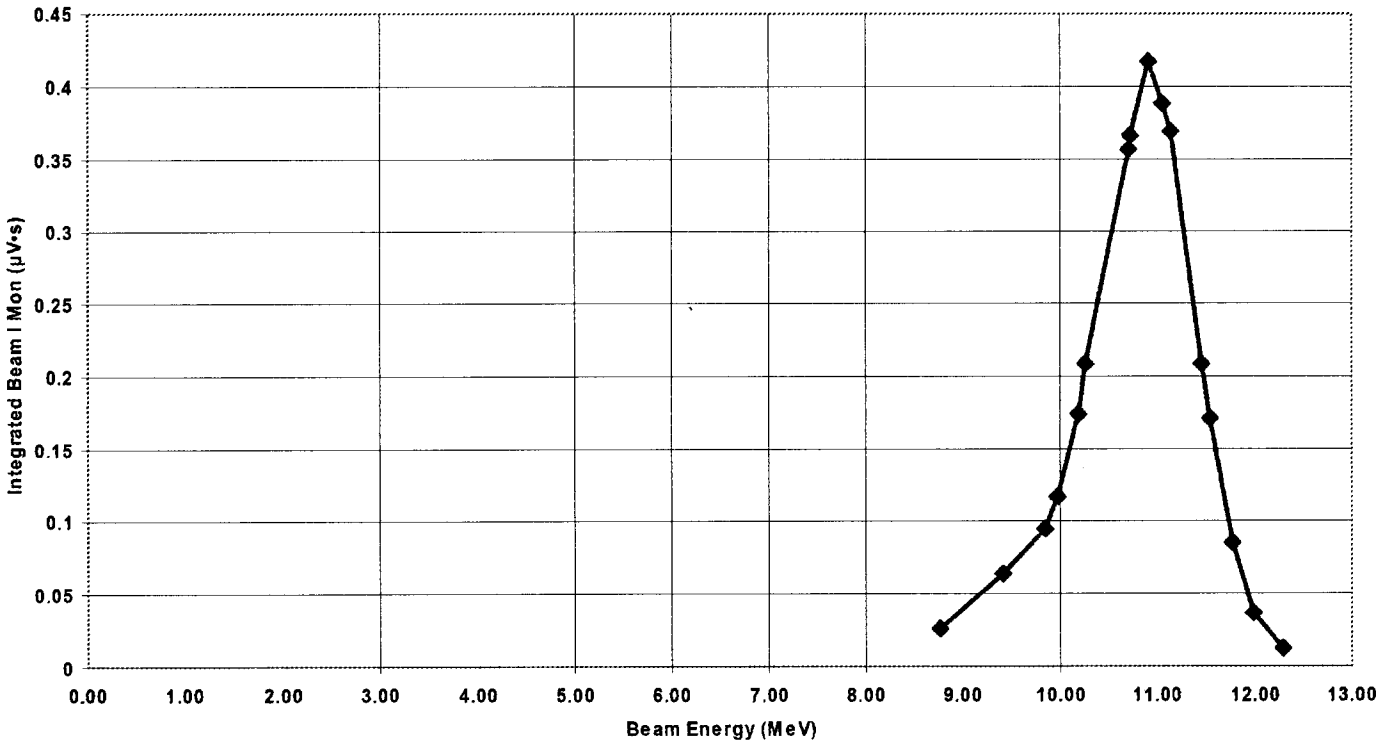
FIG. 11 shows a plot of the output energy of a set of electrons for an electron gun current of 220 mA, an electron gun voltage of 6 kV, and a RF power of 2.2 MW.
Figure 12:
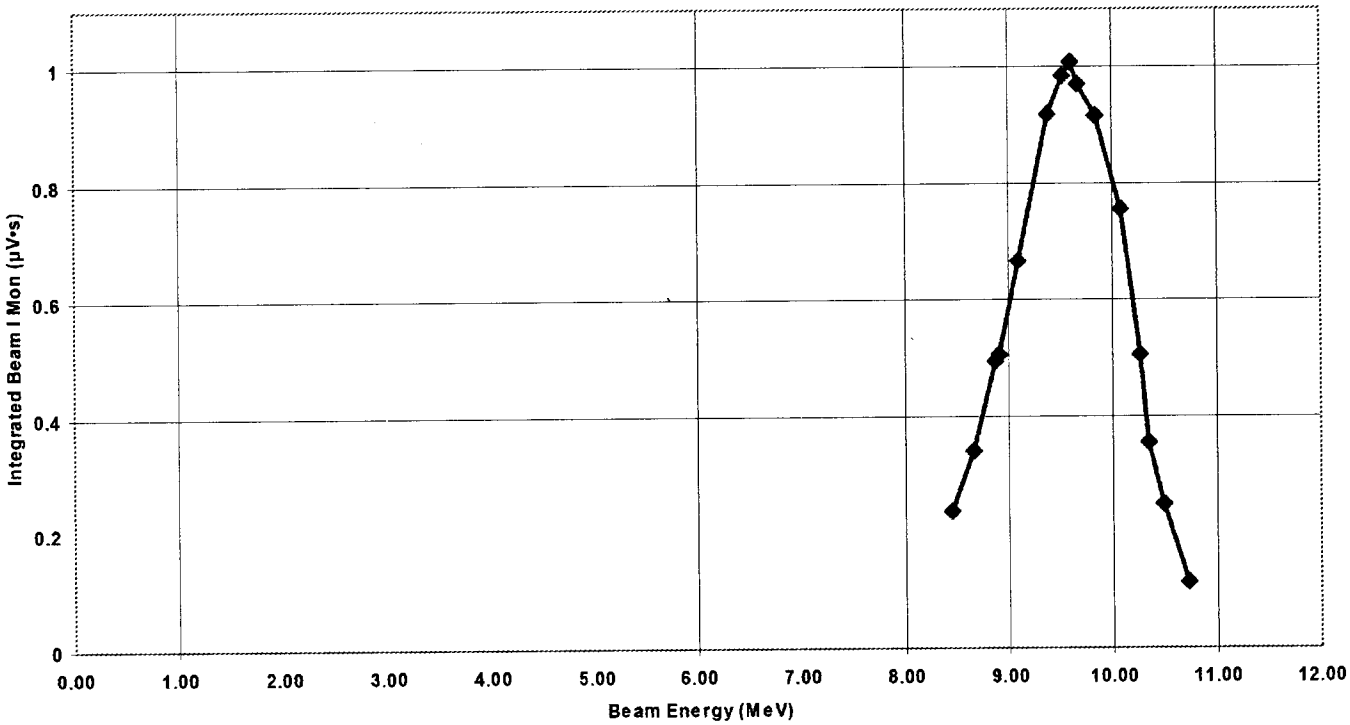
FIG. 12 shows a plot of the output energy of a set of electrons for an electron gun current of 236 mA, an electron gun voltage of 8 kV, and a RF power of 2.2 MW.
Figure 13:
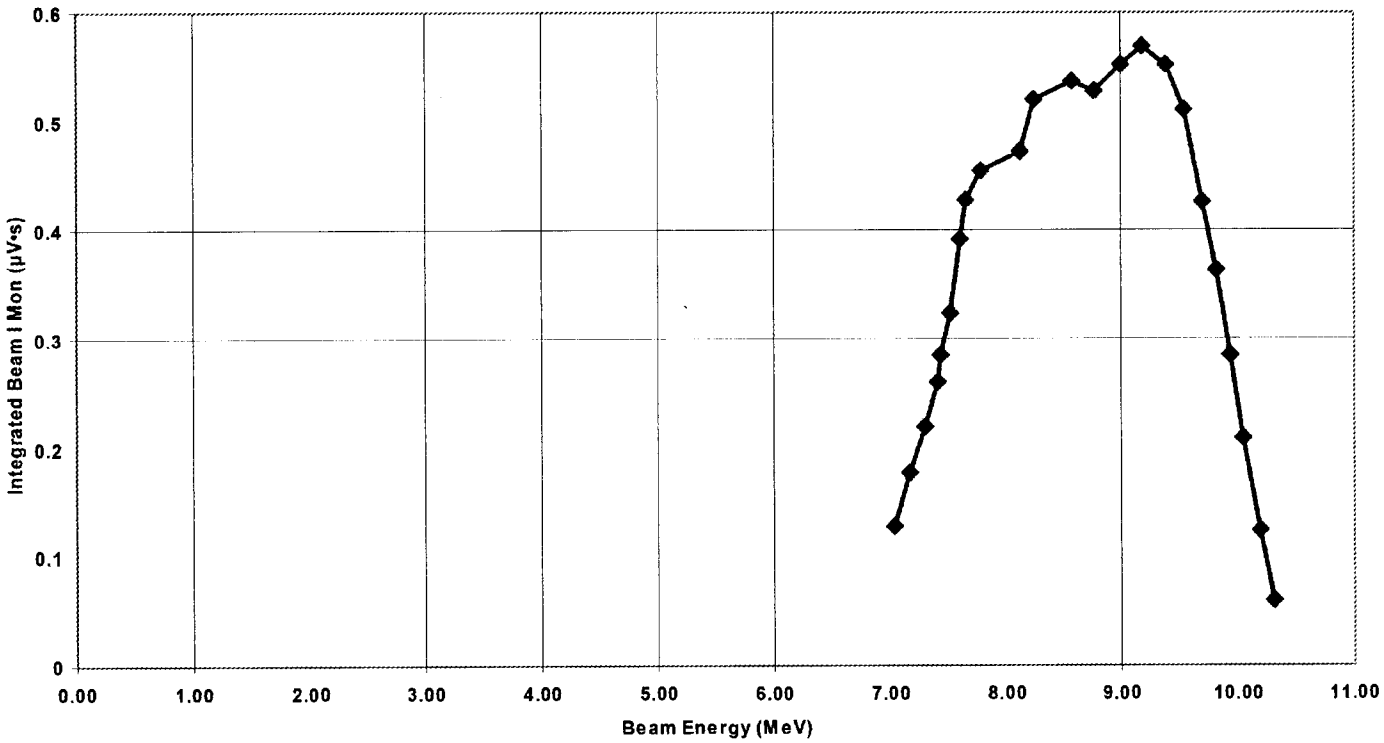
FIG. 13 shows a plot of the output energy of a set of electrons for an electron gun current of 246 mA, an electron gun voltage of 10 kV, and a RF power of 2.2 MW.

In the first measurement in Table I, both the input power of the electromagnetic wave coupled into the LINAC and electron gun current were changed along with the gun voltage to obtain an output electron beam at an energy of 7.3 MeV. FIGS. 11-13 show the energy spectrum of the set of electrons output from the LINAC for the second, third, and fourth measurement in Table I, where the power of the electromagnetic wave coupled into the LINAC is kept constant and the electron gun currents are relatively close to one another, but the gun voltages were changed.

Specifically, in FIG. 11, the set of electrons have an average output energy of 10.9 MeV for an electron gun current of 220 mA, an electron gun voltage of 6 kV, and a RF power of 2.2 MW. The set of electrons in FIG. 12 have an average output energy of 9.6 MeV for an electron gun current of 236 mA, an electron gun voltage of 8 kV, and a RF power of 2.2 MW. In FIG. 13, the set of electrons have an average output energy of 9.2 MeV for an electron gun current of 246 mA, an electron gun voltage of 10 kV, and a RF power of 2.2 MW. Without wishing to be bound by any theory, using a load line slope of 24 keV/mA of accelerated beam, it is believed that approximately 1.0 MeV of the energy increase between the second and fourth measurements listed in Table I may be due to the reduction in beam loading caused by the reduction in the accelerated beam, and about 0.7 MeV of the energy increase may be due to the electron bunch moving closer to the crest of the electromagnetic wave. Without wishing to be bound by any theory, the reason for the reduction in beam capture between the second and fourth measurements is believed to be that with a gun voltage of only 6 kV, many of the electrons that would otherwise populate the bunch are instead stopped by the retarding electric fringe fields in the entrance beam hole, and thus do not enter the first cavity. In one exemplary embodiment, the gun can be operated at a voltage selected to provide a compromise between the voltage yielding the smallest energy spread and the voltage yielding the best beam capture, e.g., at a voltage between about 7 and 8 kV.

Figure 14A:
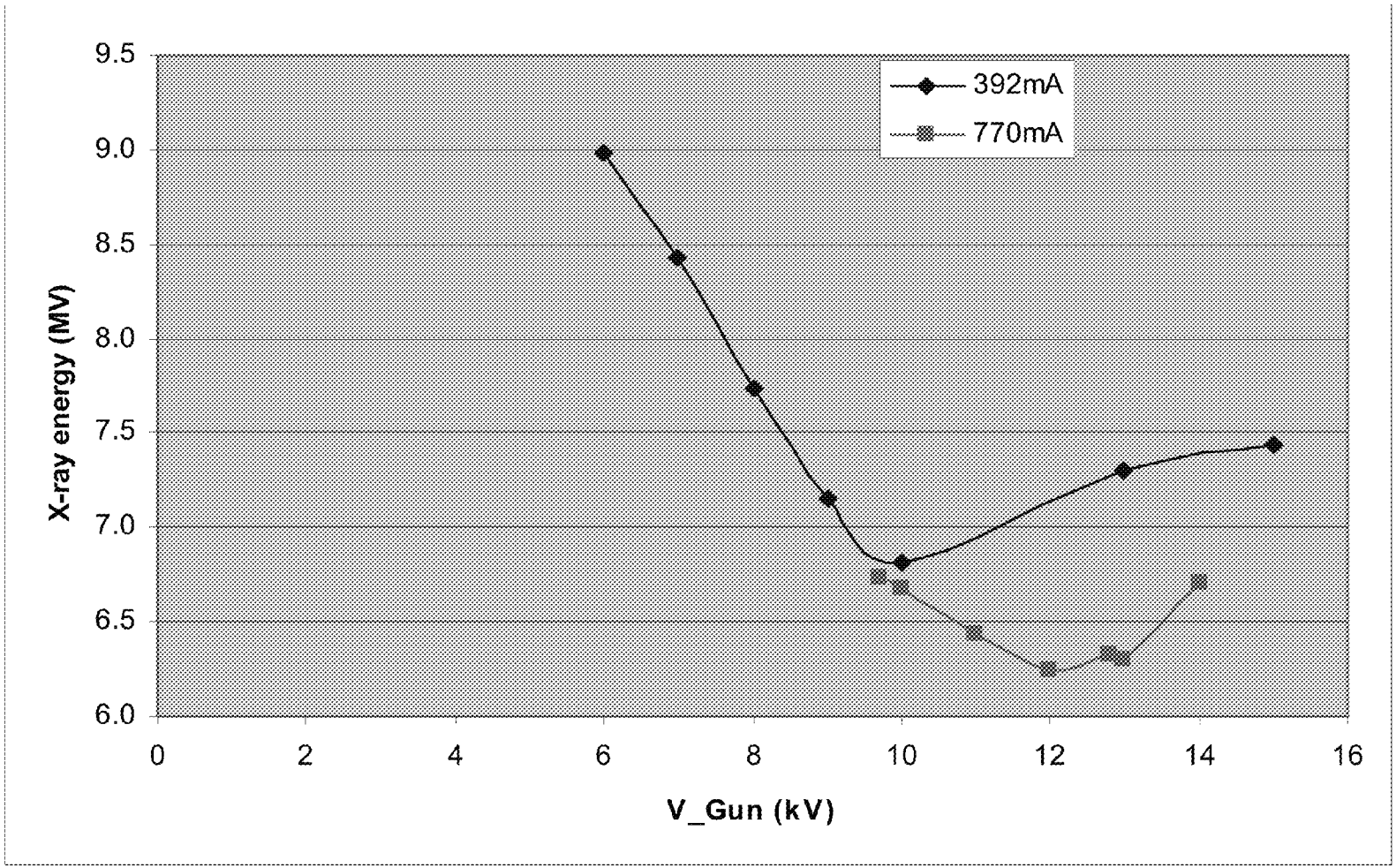
FIG. 14A shows a plot of the x-ray energy (MV) of a set of electrons as a function of electron gun voltage (kV) for electron gun currents of 770 mA and 392 mA, and a RF power of 2.2 MW.
Figure 14B:
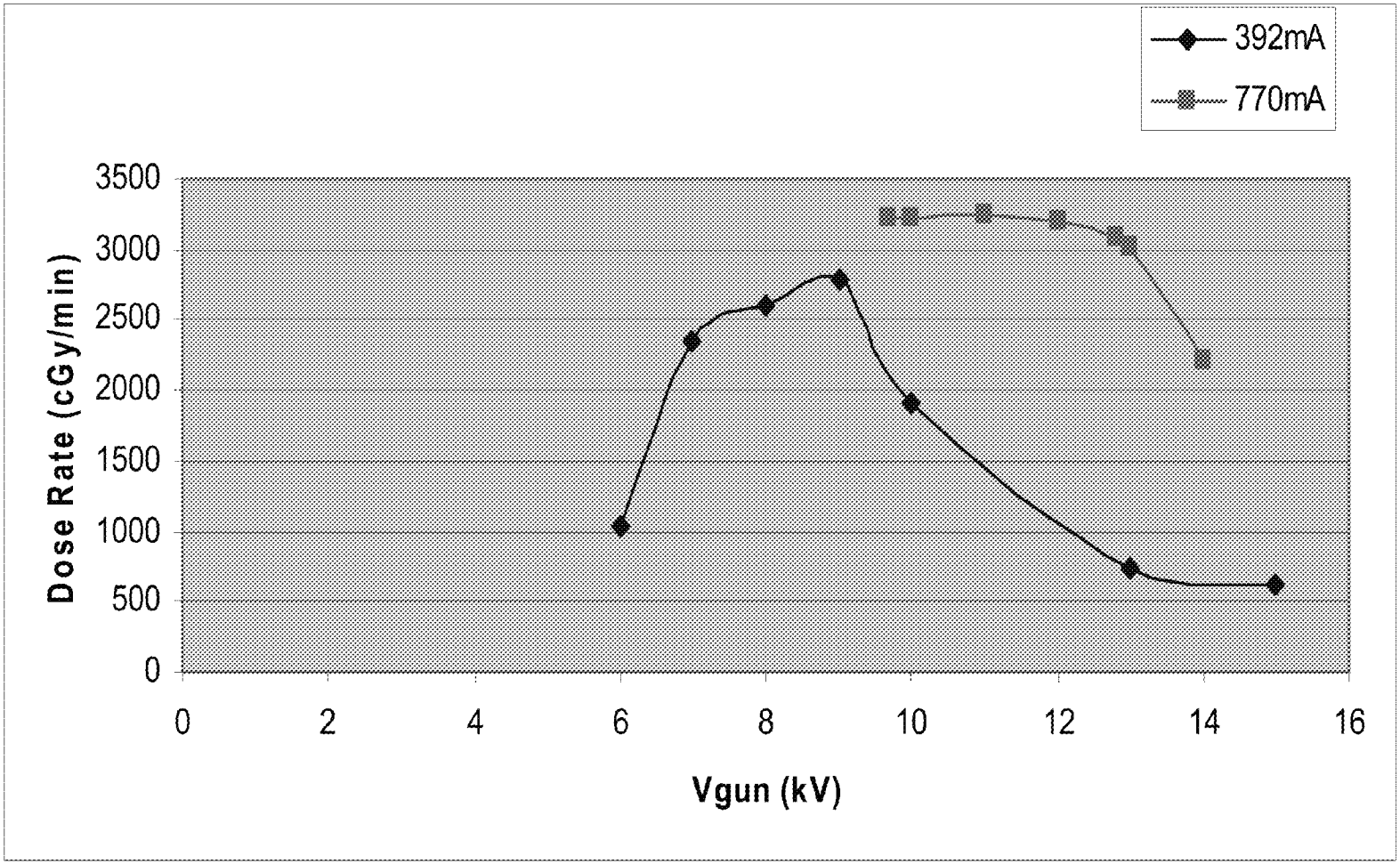
FIG. 14B shows a plot of the x-ray dose rate (cGy/min) as a function of electron gun voltage (kV) for electron gun currents of 770 mA and 392 mA, and a RF power of 2.2 MW.
Figure 14C:
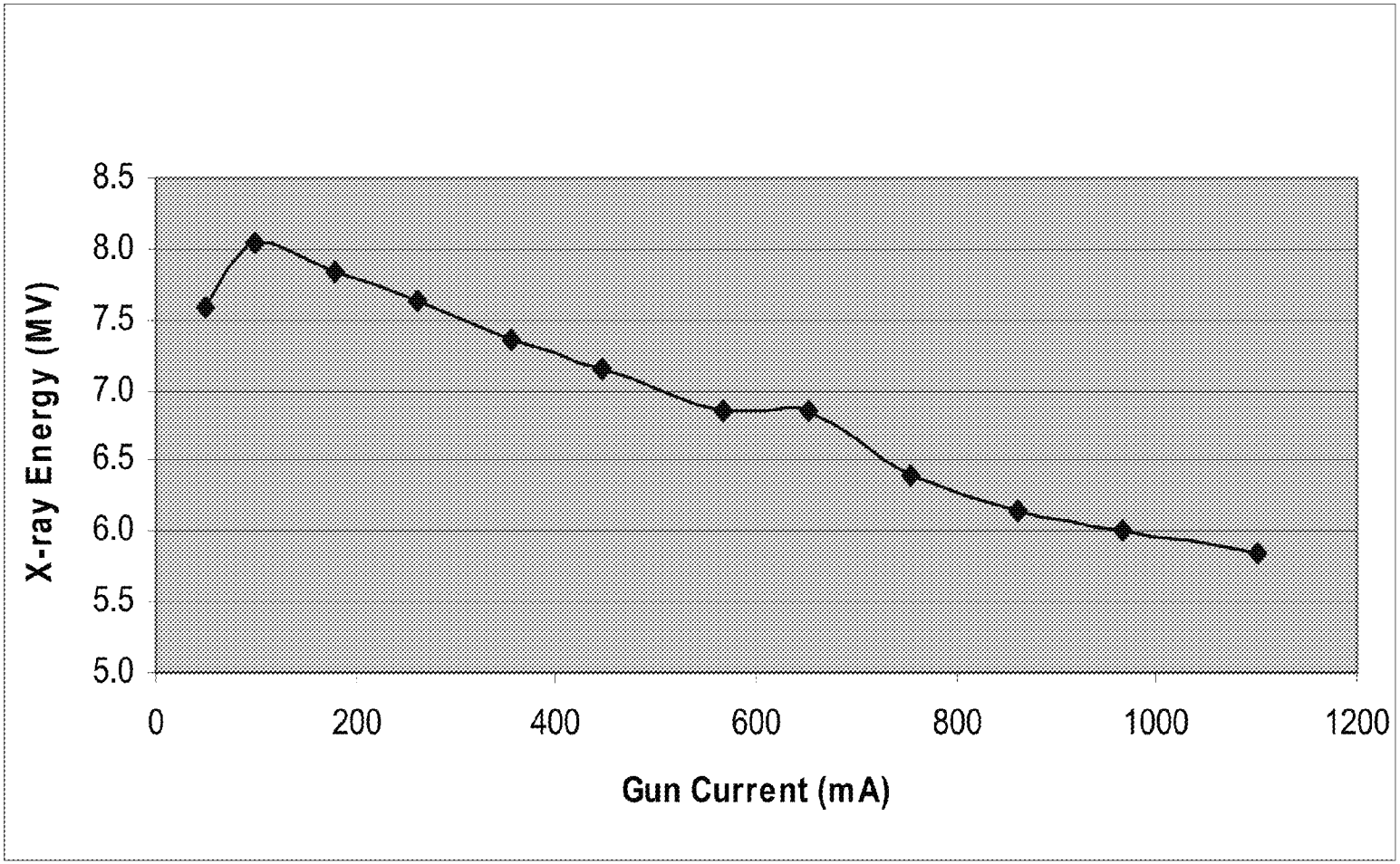
FIG. 14C shows a plot of the x-ray energy (MV) as a function of electron gun current at an electron gun voltage of 12.8 kV and a RF power of 2.2 MW.

FIG. 14A shows a plot of the x-ray energy (MV) of a set of electrons as a function of electron gun voltage (kV) for electron gun currents of 770 mA (squares) and 392 mA (diamonds). The LINAC RF power was fixed at 2.2 MW. From FIG. 14A, it can be seen that different electron gun voltages result in different x-ray energies. FIG. 14B shows a plot of the x-ray dose rate (cGy/min) as a function of electron gun voltage (kV) for electron gun currents of 770 mA (squares) and 392 mA (diamonds). The LINAC RF power was similarly fixed at 2.2 MW. From FIG. 14B, it can be seen that different electron gun voltages result in different dose rates. FIG. 14C shows a plot of the x-ray energy (MV) as a function of electron gun current at an electron gun voltage of 12.8 kV and a RF power of 2.2 MW (diamonds). The result in FIG. 14C illustrates the beam loading effect. It was observed that lowering the gun voltage during a higher energy operation of the LINAC improved the performance. The electrons with different average output energies were obtained without activation of a side cavity.

Figure 15:
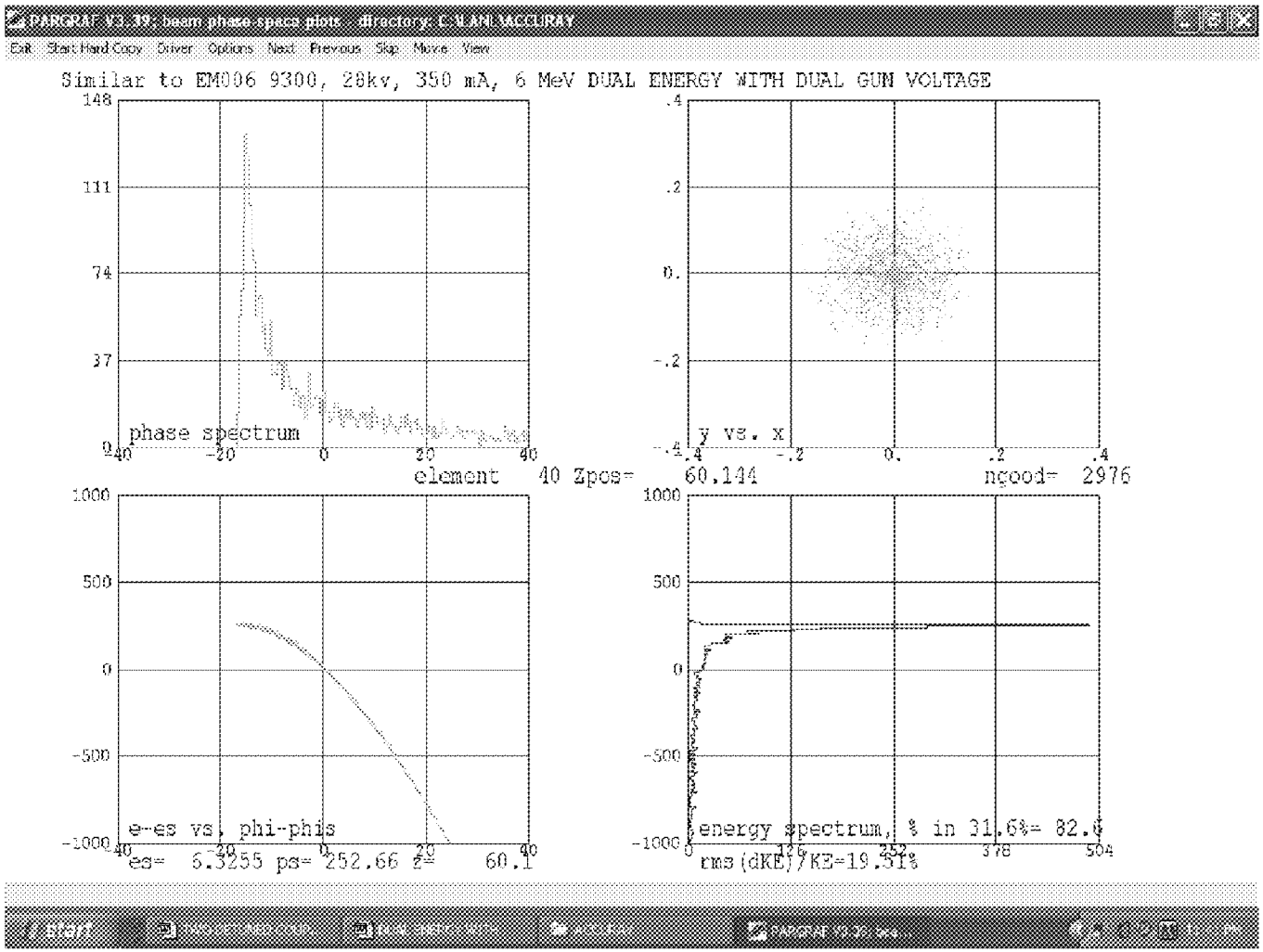
FIG. 15 shows PARMELA simulations of a LINAC running at 6 MeV with a gun voltage of 28 kV gun.
Figure 16:
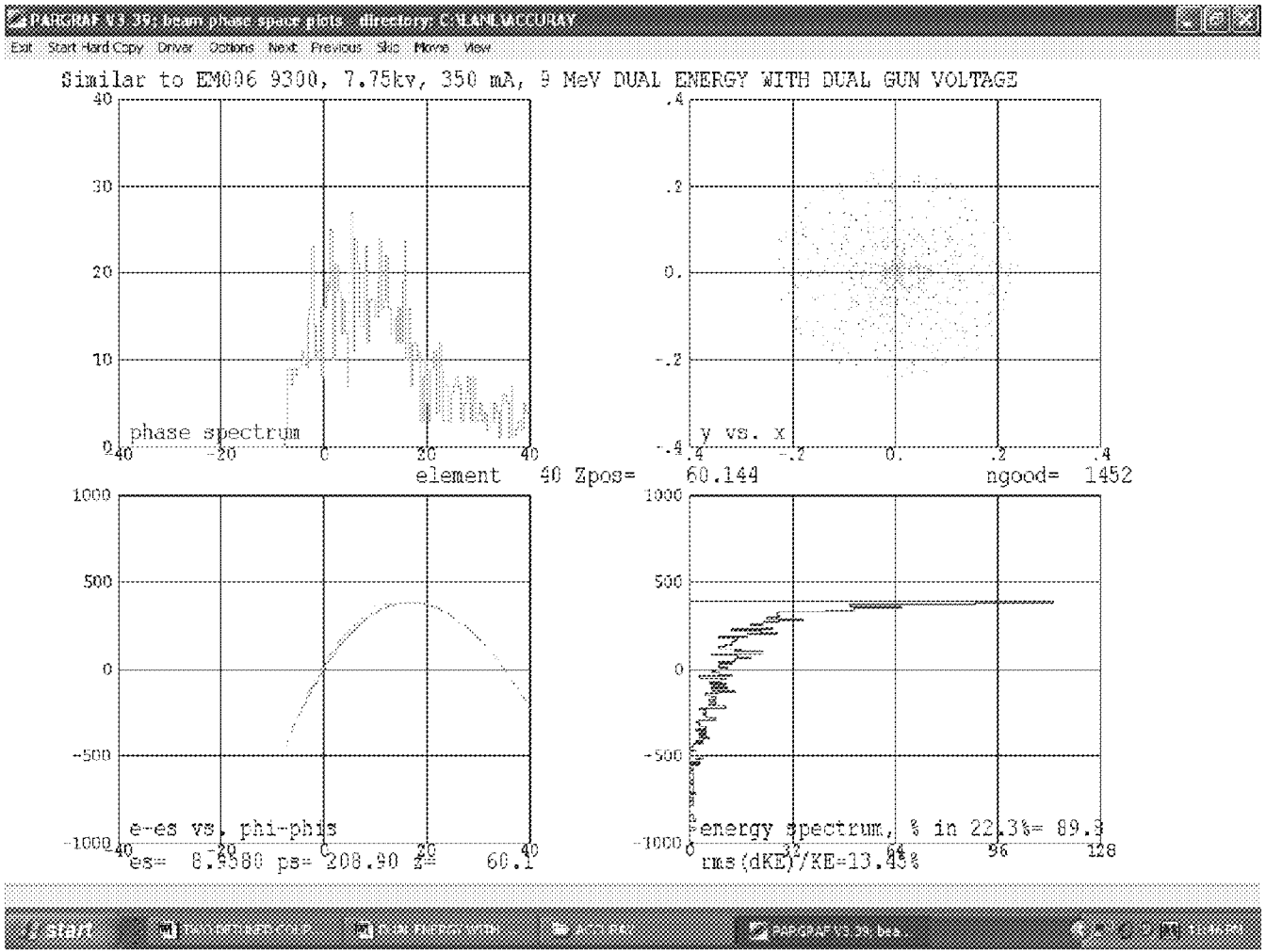
FIG. 16 shows PARMELA simulations of a LINAC running at 9 MeV with a gun voltage of 7.75 kV gun.

6.2 Simulation of Output of Electrons at Different Energies Using Electron Gun Voltage Tuning The operation of a LINAC was modeled to investigate the energy spectrum and energy stability of output electron beams. FIGS. 15 and 16 show PARMELA simulations of the results of a LINAC running at 6 MeV with a gun voltage of 28 kV gun (FIG. 15), and at 9 MeV with a gun voltage of 7.75 kV gun (FIG. 16).

The top left panel of each of FIGS. 15 and 16 shows the distribution of charge in the electron bunch, with the horizontal axis representing calibrated degrees of RF phase and the vertical axis representing number of macro particles per bin. The lower left panel of each figure shows the distribution of electrons in longitudinal phase space with the horizontal axis being the same as the plot of the top left panel, and the vertical axis being energy in units of keV relative to a reference particle. The lower right panel of each figure shows the energy spectrum, with the vertical axis representing the energy and the horizontal axis representing the number of electrons per bin. The upper right panel of each figure shows the distribution of the set of electrons in transverse (x/y) space as the set of electrons would appear on a beam profile monitor.

The simulation results show that the electron bunch can be maintained fairly close to the crest of the wave for both electron energies by changing the gun voltage. In both cases, the set of electrons contained 10,000 particles at the start. About 30% of the gun current is captured at an electron output energy of 6 MeV and about half that at an electron output energy of 9 MeV. The bunching and spectrum are much better for the 6 MeV case than the 9 MeV results. The 9 MeV case has most of the beam in about a 5% spectrum, which is applicable for X-ray LINACs.

7. REFERENCES CITED

All references cited herein are incorporated herein by reference in their entirety and for all purposes to the same extent as if each individual publication or patent or patent application was specifically and individually indicated to be incorporated by reference in its entirety herein for all purposes. Discussion or citation of a reference herein will not be construed as an admission that such reference is prior art to the present invention.

8. MODIFICATIONS

Many modifications and variations of this invention can be made without departing from its spirit and scope, as will be apparent to those skilled in the art. The specific embodiments described herein are offered by way of example only, and the invention is to be limited only by the terms of the appended claims, along with the full scope of equivalents to which such claims are entitled.

What is claimed is:

1. A method, comprising:

coupling an electromagnetic wave into an accelerator, wherein said accelerator comprises a plurality of main cavities and a plurality of side cavities, wherein each side cavity of said plurality of side cavities communicates with two neighboring main cavities of said plurality of main cavities, and wherein at least one side cavity of said plurality of side cavities comprises an activatable window positioned in said at least one side cavity; and injecting a first set of electrons into a longitudinal passageway positioned along a longitudinal axis of said accelerator, wherein said longitudinal passageway communicates with said plurality of main cavities, wherein said first set of electrons is accelerated by said electromagnetic wave in a region of said longitudinal passageway in communication with at least one of said plurality of main cavities, and wherein said first set of electrons is emitted from said accelerator at a first energy when said activatable window is not activated;

activating said activatable window by injecting charge carriers into said activatable window; and injecting a second set of electrons into said longitudinal passageway, wherein said second set of electrons is emitted from said accelerator at a second energy when said activatable window is activated.

2. The method of claim 1, wherein activating said activatable window further comprises injecting the charge carriers through PIN diodes arranged around a periphery of said activatable window.

3. The method of claim 1, wherein said at least one side cavity comprises a longitudinal axis, and wherein said at least one side cavity is positioned such that said longitudinal axis of said at least one side cavity is perpendicular to said longitudinal axis of said accelerator.

4. The method of claim 3, wherein said at least one side cavity comprising said activatable window has a substantially cylindrical cross-section.

5. The method of claim 4, wherein said at least one side cavity comprising said activatable window comprises a resonant TE01 waveguide.

6. The method of claim 5, wherein said resonant TE01 waveguide has a length approximately equal to a guided wavelength of the electromagnetic wave.

7. The method of claim 5, wherein said resonant TE01 waveguide has a length approximately equal to a half of a guided wavelength of the electromagnetic wave.

8. The method of claim 3, wherein said activatable window is positioned near an end of said at least one side cavity.

9. The method of claim 8, wherein the accelerator comprises a thermal conductor positioned between said activatable window and said end of said at least one side cavity.

10. The method of claim 1, wherein, when said activatable window is not activated, said activatable window transmits more than 50% of a component of said electromagnetic wave which is fed into said at least one side cavity comprising said activatable window, and wherein said activating said activatable window causes said activatable window to transmit less than 50% of a component of said electromagnetic wave.

11. A standing wave linear accelerator, comprising:

a plurality of main cavities and a plurality of side cavities, wherein each side cavity of said plurality of side cavities communicates with two neighboring main cavities of said plurality of main cavities, and wherein at least one side cavity of said plurality of side cavities comprises an activatable window positioned in said at least one side cavity, thereby providing at least one detunable side cavity, wherein said activatable window comprises a doped silicon wafer window, and wherein said at least one detunable side cavity is configured such that a standing wave is disrupted in main cavities of said plurality of main cavities located downstream of said at least one detunable side cavity when said activatable window is activated.

12. The standing wave linear accelerator of claim 11, wherein said activatable window is activated by injecting charge carriers into said activatable window.

13. The standing wave linear accelerator of claim 11, wherein said at least one side cavity comprising said activatable window has a cylindrical cross-section.

14. The standing wave linear accelerator of claim 13, wherein said at least one side cavity comprising said activatable window comprises a resonant TE01 waveguide.

15. The standing wave linear accelerator of claim 14, wherein said resonant TE01 waveguide has a length approximately equal to a guided wavelength of the electromagnetic wave.

16. The standing wave linear accelerator of claim 14, wherein said resonant TE01 waveguide has a length approximately equal to a half of a guided wavelength of the electromagnetic wave.

17. The standing wave linear accelerator of claim 13, wherein said activatable window is positioned near an end of said at least one side cavity.

18. The standing wave linear accelerator of claim 17, further comprising a thermal conductor positioned between said activatable window and said end of said at least one side cavity.

19. A standing wave linear accelerator, comprising:

a plurality of main cavities and a plurality of side cavities, wherein each side cavity of said plurality of side cavities communicates with two neighboring main cavities of said plurality of main cavities, and wherein at least one side cavity of said plurality of side cavities comprises an activatable window positioned in said at least one side cavity, thereby providing at least one detunable side cavity, wherein said activatable window comprises a plasma switch, and wherein said at least one detunable side cavity is configured such that a standing wave is disrupted in main cavities of said plurality of main cavities located downstream of said at least one detunable side cavity when said activatable window is activated.

* * * * *